US009746817B2

(12) United States Patent
Gohda et al.

(10) Patent No.: US 9,746,817 B2
(45) Date of Patent: Aug. 29, 2017

(54) CLEANING BLADE WITH ELASTIC MEMBER INCLUDING REFORMED LAYER, IMAGE FORMING APPARATUS, AND PROCESS CARTRIDGE WITH THE SAME

(71) Applicants: Shohei Gohda, Kanagawa (JP); Shinji Nohsho, Tokyo (JP); Masanobu Gondoh, Kanagawa (JP); Kaori Toyama, Kanagawa (JP); Yohta Sakon, Kanagawa (JP); Masahiro Ohmori, Kanagawa (JP)

(72) Inventors: Shohei Gohda, Kanagawa (JP); Shinji Nohsho, Tokyo (JP); Masanobu Gondoh, Kanagawa (JP); Kaori Toyama, Kanagawa (JP); Yohta Sakon, Kanagawa (JP); Masahiro Ohmori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/538,027

(22) Filed: Nov. 11, 2014

(65) Prior Publication Data

US 2015/0139711 A1 May 21, 2015

(30) Foreign Application Priority Data

Nov. 15, 2013 (JP) ..... 2013-236706

(51) Int. Cl.

| | |
|---|---|
| ***G03G 15/00*** | (2006.01) |
| ***G03G 21/00*** | (2006.01) |
| *G03G 15/16* | (2006.01) |

(52) U.S. Cl.

CPC ..... *G03G 21/0017* (2013.01); *G03G 15/162* (2013.01)

(58) Field of Classification Search

CPC ..... G03G 15/162; G03G 21/0017

(Continued)

(56) References Cited

U.S. PATENT DOCUMENTS

| | | | |
|---|---|---|---|
| 4,957,839 | A | 9/1990 | Rokutanzono et al. |
| 5,008,172 | A | 4/1991 | Rokutanzono et al. |

(Continued)

FOREIGN PATENT DOCUMENTS

| | | | |
|---|---|---|---|
| CN | 103163763 | B | 10/2015 |
| JP | 2004-233818 | | 8/2004 |

(Continued)

OTHER PUBLICATIONS

European search report dated May 6, 2015 in corresponding European Patent Application No. 14193073.

(Continued)

*Primary Examiner* — David M Gray
*Assistant Examiner* — Michael Harrison
(74) *Attorney, Agent, or Firm* — Cooper & Dunham LLP

(57) ABSTRACT

Provided is a cleaning blade including an elastic member configured to abut on a surface of a cleaning target member and remove residual material deposited thereon, wherein elastic member satisfies requirements a to c below, a. an abutment part of the elastic member to abut on the surface of the cleaning target member has a reformed layer, b. Martens hardness at a surface of the reformed layer is from 1.5 to 15 $N/mm^2$, and c. a relationship H/L between maximum Martens hardness H among Martens hardnesses H in a region inward from the abutment part thicknesswise and distance L from the surface of the reformed layer is from 0.010 to 0.2 ($N/mm^2 \cdot 1/\mu m$), where distance L represents minimum distance among distances to the surface of the (Continued)

reformed layer, from positions at which a measured Martens hardness and a measured elastic power are equal to those of the elastic member.

12 Claims, 6 Drawing Sheets

(58) Field of Classification Search
USPC ..... 399/350, 303, 333
See application file for complete search history.

(56) References Cited

U.S. PATENT DOCUMENTS

| | | | |
|---|---|---|---|
| 5,147,751 | A | 9/1992 | Kojima et al. |
| 5,342,718 | A | 8/1994 | Nousho et al. |
| 5,991,573 | A | 11/1999 | Nohsho et al. |
| 6,030,733 | A | 2/2000 | Kami et al. |
| 6,060,205 | A | 5/2000 | Takeichi et al. |
| 6,151,468 | A | 11/2000 | Kami et al. |
| 6,160,977 | A | 12/2000 | Takeichi et al. |
| 6,363,237 | B1 | 3/2002 | Nagame et al. |
| 6,521,386 | B1 | 2/2003 | Sakon et al. |
| 6,558,862 | B2 | 5/2003 | Kojima et al. |
| 6,562,529 | B1 | 5/2003 | Kojima et al. |
| 7,274,898 | B2 | 9/2007 | Nousho et al. |
| 8,059,992 | B2 | 11/2011 | Yasuda et al. |
| 8,293,439 | B2 | 10/2012 | Fujiwara et al. |
| 8,369,769 | B2 | 2/2013 | Ohmori et al. |
| 8,606,150 | B2 | 12/2013 | Yamashita et al. |
| 8,644,753 | B2 | 2/2014 | Ohmori et al. |
| 2002/0051654 | A1 | 5/2002 | Niimi et al. |
| 2002/0115005 | A1 | 8/2002 | Ikuno et al. |
| 2002/0197549 | A1 | 12/2002 | Sakon et al. |
| 2003/0035661 | A1 | 2/2003 | Kabata et al. |
| 2003/0049555 | A1 | 3/2003 | Sakon et al. |
| 2003/0152854 | A1 | 8/2003 | Kojima et al. |
| 2003/0165757 | A1 | 9/2003 | Kojima et al. |
| 2003/0219279 | A1 | 11/2003 | Nohsho et al. |
| 2004/0048178 | A1 | 3/2004 | Ikuno et al. |
| 2004/0058260 | A1 | 3/2004 | Katoh et al. |
| 2005/0026058 | A1 | 2/2005 | Kami et al. |
| 2005/0031377 | A1 | 2/2005 | Kabata et al. |
| 2005/0053853 | A1 | 3/2005 | Sugino et al. |
| 2005/0118518 | A1 | 6/2005 | Ikegami et al. |
| 2005/0238977 | A1 | 10/2005 | Kojima et al. |
| 2006/0210908 | A1 | 9/2006 | Umemura et al. |
| 2006/0269323 | A1 | 11/2006 | Kabata et al. |
| 2007/0287083 | A1 | 12/2007 | Gondoh et al. |
| 2008/0112742 | A1 | 5/2008 | Nakamori et al. |
| 2008/0113285 | A1 | 5/2008 | Nakamori et al. |
| 2008/0219694 | A1 | 9/2008 | Nakamori et al. |
| 2009/0154971 | A1* | 6/2009 | Itoh et al. ..... 399/350 |
| 2009/0311017 | A1 | 12/2009 | Ohmori et al. |
| 2010/0067953 | A1 | 3/2010 | Nohsho et al. |
| 2010/0329741 | A1 | 12/2010 | Nohsho et al. |
| 2011/0135361 | A1 | 6/2011 | Kabata et al. |
| 2012/0009513 | A1* | 1/2012 | Iwamoto et al. ..... 430/56 |
| 2012/0063826 | A1* | 3/2012 | Ohmori et al. ..... 399/350 |
| 2013/0064578 | A1 | 3/2013 | Yamashita et al. |
| 2013/0149541 | A1* | 6/2013 | Sakamoto et al. ..... 428/411.1 |
| 2013/0243506 | A1 | 9/2013 | Ikuno et al. |
| 2013/0243507 | A1 | 9/2013 | Sakon et al. |
| 2014/0064810 | A1 | 3/2014 | Iwamoto et al. |
| 2014/0205338 | A1* | 7/2014 | Gondoh ..... G03G 21/0017 399/350 |

FOREIGN PATENT DOCUMENTS

| | | | |
|---|---|---|---|
| JP | 3602898 | | 10/2004 |
| JP | 2010-152295 | | 7/2010 |
| JP | 2012-53314 | | 3/2012 |
| JP | 2012053314 | A * | 3/2012 |
| JP | 2012-083729 | | 4/2012 |
| JP | 2014-142597 | | 8/2014 |

OTHER PUBLICATIONS

U.S. Appl. No. 14/134,579, filed Dec. 19, 2013.
U.S. Appl. No. 14/132,444, filed Dec. 18, 2013.
U.S. Appl. No. 08/879,992, filed Jun. 20, 1997.
Chinese official action dated Aug. 16, 2016 in corresponding Chinese Patent Application No. 20141064643.2.

* cited by examiner

PRIOR ART

Perimeter: C1
Particle projected area: S

Circle having area S
Perimeter: C2

CLEANING BLADE WITH ELASTIC MEMBER INCLUDING REFORMED LAYER, IMAGE FORMING APPARATUS, AND PROCESS CARTRIDGE WITH THE SAME

BACKGROUND OF THE INVENTION

Field of the Invention

The present invention relates to a cleaning blade, an image forming apparatus, and a process cartridge.

Description of the Related Art

Conventionally, electrophotographic image forming apparatuses remove residual toner deposited on the surface of an image bearing member after having transferred a toner image onto a recording medium or an intermediate transfer medium in an image forming step, with a cleaning unit.

A cleaning blade is used as the cleaning unit because a cleaning blade has a simple structure and is excellent in cleaning performance. The cleaning blade is typically constituted by an elastic member made of polyurethane rubber or the like, and a support member. With a base end of the elastic member supported on the support member, an abutment part (a leading end edge portion) of the elastic member is thrust against the surface of the image bearing member, in order for the residual toner on the surface of the image bearing member to be removed by being banked up and scraped off.

However, as shown in FIG. 1A, a frictional force between the image bearing member 123 and the cleaning blade 62 made of polyurethane rubber may increase to drag the cleaning blade 62 in the moving direction of the image bearing member 123 and make the abutment part (the leading end edge portion) 62*c* of the cleaning blade 62 ride up. Further, if the cleaning is continued with the abutment part 62*c* of the cleaning blade 62 ridden up, a local wear X may occur at a location of a leading end surface 62*a* of the cleaning blade 62 that is several μm away from the abutment part 62*c*, as shown in FIG. 1B. If the cleaning is further continued in this state, the local wear X may become larger to finally drop off the abutment part 62*c*, as shown in FIG. 1C. If the abutment part 62*c* is dropped off in this way, it is no longer possible for toner to be cleaned away properly, leading to a problem that a cleaning failure occurs. Note that the reference numeral 62*b* in FIG. 1A to FIG. 1C denotes a lower surface of the cleaning blade.

Hence, there has been an attempt to make the abutment part safe from deformation by enhancing the hardness thereof in order to suppress the riding up of the abutment part (the leading end edge portion) of the cleaning blade that is to abut on the surface of the image bearing member. For example, there are proposals to provide a surface layer containing an ultraviolet-curable resin over the abutment part of the cleaning blade or the elastic member to enhance the hardness of the abutment part, to thereby prevent riding up or deformation of the abutment part (see Japanese Patent (JP-B) No. 3602898, and Japanese Patent Application Laid-Open (JP-A) Nos. 2004-233818 and 2010-152295).

However, the ultraviolet-curable resin used in these proposals has a high crosslink density. Therefore, when the surface layer provided over the abutment part is cured, it undergoes large cure shrinkage, leading to a problem that the surface layer cracks or the surface layer peels.

Hence, it is requested to provide a cleaning blade that can suppress an abutment part of an elastic member thereof to abut on the surface of a cleaning target member from riding up, that has little wear over the abutment part of the elastic member during use, and that can maintain favorable cleaning performance for a long term.

SUMMARY OF THE INVENTION

An object of the present invention is to provide a cleaning blade that can suppress an abutment part of an elastic member thereof to abut on the surface of a cleaning target member from riding up, that has little wear over the abutment part of the elastic member during use, and that can maintain favorable cleaning performance for a long term.

To solve the problems described above, a cleaning blade of the present invention includes:

an elastic member configured to abut on a surface of a cleaning target member and remove a residual material deposited on the surface of the cleaning target member, wherein the elastic member satisfies requirements a to c below, a. an abutment part of the elastic member that is to abut on the surface of the cleaning target member has a reformed layer, b. a Martens hardness at a surface of the reformed layer is from 1.5 $N/mm^2$ to 15 $N/mm^2$, and c. a relationship H/L between a maximum Martens hardness H among Martens hardnesses H in a region inward from the abutment part thicknesswise and a distance L from the surface of the reformed layer is from 0.010 ($N/mm^2 \cdot 1/\mu m$) to 0.2 ($N/mm^2 \cdot 1/m$), where the distance L represents a minimum distance among distances to the surface of the reformed layer, from positions at which a measured Martens hardness is equal to a Martens hardness of the elastic member, and a measured elastic power is equal to an elastic power of the elastic member.

The present invention can provide a cleaning blade that can solve conventional problems described above, can achieve the object described above, that can suppress an abutment part of an elastic member thereof to abut on the surface of a cleaning target member from riding up, that has little wear over the abutment part of the elastic member during use, and that can maintain favorable cleaning performance for a long term.

DETAILED DESCRIPTION OF THE INVENTION

Figure 1A:
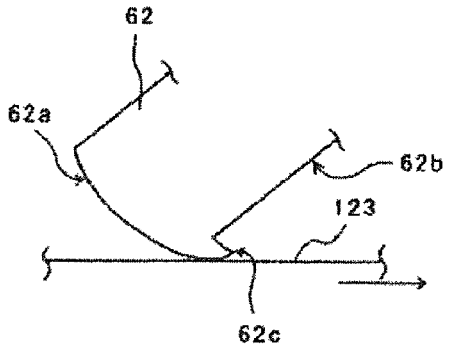
FIG. 1A is a diagram showing a state of an abutment part of a conventional cleaning blade riding up.

A cleaning blade of the present invention includes an elastic member configured to abut on a surface of a cleaning target member and remove a residual material deposited on the surface of the cleaning target member, and the elastic member satisfies requirements a to c below.

a. an abutment part of the elastic member that is to abut on the surface of the cleaning target member has a reformed layer, and b. a Martens hardness at a surface of the reformed layer is from 1.5 $N/mm^2$ to 15 $N/mm^2$, c. a relationship H/L between a maximum Martens hardness H among Martens hardnesses H in a region inward from the abutment part thicknesswise and a distance L from the surface of the reformed layer is from 0.010 ($N/mm^2 \cdot 1/\mu m$) to 0.2 ($N/mm^2 \cdot 1/\mu m$).

Note that the distance L represents a minimum distance among distances to the surface of the reformed layer, from positions at which a measured Martens hardness is equal to a Martens hardness of the elastic member, and a measured elastic power is equal to an elastic power of the elastic member.

A cleaning blade, an image forming apparatus, and a process cartridge of the present invention will be explained below with reference to the drawings. The present invention is not limited to an embodiment described below, and modifications within a range imaginable by a person having ordinary skill in the art are possible by means of any other embodiment, addition, alteration, deletion, etc. Any mode is to be included in the scope of the present invention, as long as it has functions and effects of the present invention.

(Cleaning Blade)

The cleaning blade of the present invention includes an elastic member configured to abut on a surface of a cleaning target member and remove a residual material deposited on the surface of the cleaning target member, and also includes a support member, and according to necessity, other members.

It is preferable that the cleaning blade be constituted by a support member, and a flat-plate-shaped elastic member of which one end is joined to the support member, and of which other end is a free end having a predetermined length. The cleaning blade is positioned such that an abutment part of the elastic member, which is one of ends of the elastic member at the free end side, abuts on the surface of the cleaning target member along a longer direction of the cleaning target member.

<Cleaning Target Member>

The material, shape, structure, size, etc. of the cleaning target member are not particularly limited, and may be appropriately selected according to the purpose. Examples of the shape of the cleaning target member include a drum shape, a belt shape, a flat plate shape, and a sheet shape. The size of the cleaning target member is not particularly limited, and may be appropriately selected according to the purpose, but is preferably a size of a level usually used.

The material of the cleaning target member is not particularly limited, and may be appropriately selected according to the purpose. Examples thereof include metal, plastic, and ceramic.

The cleaning target member is not particularly limited, and an arbitrary cleaning target member may be selected according to the purpose. Examples thereof include an image bearing member, when the cleaning blade is employed on an image forming apparatus.

<Residual Material>

The residual material is not particularly limited, and an arbitrary residual material may be selected according to the purpose, as long as it can be a target to be removed by the cleaning blade. Examples thereof include a toner, a lubricant, inorganic particles, organic particles, mote, and dust, or a mixture of these.

<Support Member>

The shape, size, material, etc. of the support member are not particularly limited, and may be appropriately selected according to the purpose. Examples of the shape of the support member include a flat plate shape, a strip shape, and a sheet shape. The size of the support member is not particularly limited, and may be appropriately selected according to the size of the cleaning target member.

Examples of the material of the support member include metal, plastic, and ceramic. Among these, a metal plate is preferable in terms of strength, and a steel plate made of stainless steel or the like, an aluminum plate, and a phosphor-bronze plate are particularly preferable.

<Elastic Member>

The shape, material, size, structure, etc. of the elastic member are not particularly limited, and may be appropriately selected according to the purpose. Examples of the shape of the elastic member include a flat plate shape, a strip shape, and a sheet shape. The size of the elastic member is not particularly limited, and may be appropriately selected according to the size of the cleaning target member.

The material of the elastic member is not particularly limited, and may be appropriately selected according to the purpose. Polyurethane rubber, polyurethane elastomer, and the like are preferable because a high elasticity is easily obtained.

The elastic member is not particularly limited, and an arbitrary elastic member may be selected according to the purpose. For example, it may be produced by preparing a polyurethane prepolymer using a polyol compound and a polyisocyanate compound, adding a curing agent, and according to necessity, a curing catalyst to the polyurethane prepolymer, making it undergo cross-linking in a predetermined mold, making it undergo subsequent cross-linking in a furnace, molding the obtained product into a sheet shape by centrifugal molding, aging the obtained product by leaving it under normal temperature, and cutting it into a flat plate shape having a predetermined dimension.

The polyol compound is not particularly limited, and an arbitrary polyol compound may be selected according to the purpose. Examples thereof include a high molecular weight polyol, and a low molecular weight polyol.

Examples of the high molecular weight polyol include: polyester polyol which is a condensate of alkylene glycol with aliphatic dibasic acid; polyester-based polyol such as polyester polyol of alkylene glycol with adipic acid, such as ethylene adipate ester polyol, butylene adipate ester polyol, hexylene adipate ester polyol, ethylene propylene adipate ester polyol, ethylene butylene adipate ester polyol, and ethylene neopentylene adipate ester polyol; polycaprolactone-based polyol such as polycaprolactone ester polyol obtained by ring-opening-polymerizing caprolactone; and polyether-based polyol such as poly(oxytetramethylene)glycol, and poly(oxypropyelene)glycol. One of these may be used alone, or two or more of these may be used in combination.

Examples of the low molecular weight polyol include: dihydric alcohol such as 1,4-butanediol, ethylene glycol, neopentyl glycol, hydroquinone-bis(2-hydroxyethyl)ether, 3,3'-dichloro-4,4'-diaminodiphenylmethane, and 4,4'-diaminodiphenylmethane and trihydric or higher polyhydric alcohol such as 1,1,1-trimethylolpropane, glycerin, 1,2,6-hexanetirol, 1,2,4-butanetriol, trimethylolethane, 1,1,1-tris(hydroxyethoxymethyl)propane, diglycerin, and pentaerythritol. One of these may be used alone, or two or more of these may be used in combination.

The polyisocyanate compound is not particularly limited, and an arbitrary polyisocyanate compound may be selected according to the purpose. Examples thereof include methylene diphenyl diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDI), hydrogenated xylylene diisocyanate (H6XDI), dicyclohexylmethane diisocyanate (H12MDI), hexamethylene diisocyanate (HDI), dimer acid diisocyanate (DDI), norbornene diisocyanate (NBDI), and trimethylhexamethylene diisocyanate (TMDI). One of these may be used alone, or two or more of these may be used in combination.

The curing catalyst is not particularly limited, and an arbitrary curing catalyst may be selected according to the purpose. Examples thereof include 2-methylimidazole, and 1,2-dimethylimidazole.

The content of the curing catalyst is not particularly limited, and may be appropriately selected according to the purpose. However, it is preferably from 0.01% by mass to 0.5% by mass, and more preferably from 0.05% by mass to 0.3% by mass.

A JIS-A hardness of the elastic member is not particularly limited, and may be appropriately selected according to the purpose. However, it is preferably 60 degrees or greater, and more preferably from 65 degrees to 80 degrees. When the JIS-A hardness is less than 60 degrees, it may be hard to obtain a linear load from the blade, which tends to make the area over which the blade abuts on the image bearing member large, leading to a cleaning failure.

The elastic member is not particularly limited, and an arbitrary elastic member may be selected according to the purpose. However, it is preferable that the elastic member be a layered product obtained by integrally molding two or more kinds of rubbers having different JIS-A hardnesses, because such a layered product can satisfy wear resistance and followability at the same time.

The JIS-A hardness of the elastic member can be measured with, for example, a microhardness tester MD-1 manufactured by Kobunshi Keiki Co., Ltd.

A modulus of repulsion elasticity of the elastic member according to JIS K6255 standard is not particularly limited, and may be appropriately selected according to the purpose. However, it is preferably 35% or lower, and more preferably from 20% to 30% at 23° C. When the modulus of repulsion elasticity is greater than 35%, the elastic member of the cleaning blade may have stickiness, which may lead to a cleaning failure.

The modulus of repulsion elasticity of the elastic member can be measured with, for example, RESILIENCE TESTER NO. 221 manufactured by Toyo Seiki Seisaku-Sho, Ltd. at 23° C. according to JIS K6255 standard.

The average thickness of the elastic member is not particularly limited, and may be appropriately selected according to the purpose. However, it is preferably from 1.0 mm to 3.0 mm.

What is meant by "the abutment part of the elastic member that is to abut on the surface of the cleaning target member having a reformed layer" described above is that a reforming treatment has been applied to the abutment part. The reformed layer may be not only provided over the surface of the abutment part, but also included inside the abutment part, which means that in the case of forming a surface layer over the abutment part, the reformed layer may be included inside the abutment part, and at the same time, may form the surface layer over the abutment part. As long as the material constituting the reformed layer is included in at least the abutment part of the elastic member, the material constituting the reformed layer may also be included in the other portions of the elastic member than the abutment part.

A reforming agent is used in the reforming treatment. The reforming agent is not particularly limited, and an arbitrary reforming agent may be selected according to the purpose.

The method for the reforming treatment is not particularly limited, and an appropriate method may be selected according to the purpose. For example, examples include (1) a method of impregnating the abutment part of the elastic member with the reforming agent by brush coating, dip coating, etc., and after this, curing the reforming agent, (2) a method of impregnating the abutment part of the elastic member with the reforming agent by brush coating, dip coating, etc., and after this, forming a surface layer over the abutment part by spray coating of the reforming agent, and curing the reforming agent, and (3) a method of impregnating the abutment part of the elastic member with the reforming agent by brush coating, dip coating, etc., curing the reforming agent, and after this, forming a surface layer over the abutment part by spray coating of the reforming agent. Among these, the method (1) is preferable.

The reforming agent is not particularly limited as described above. An example thereof is a product obtained by diluting an ultraviolet-curable composition described later with cyclohexanone or the like. Another example thereof is a product obtained by diluting a thermosetting component or a thermoplastic component with a diluting solvent.

When the abutment part of the elastic member that is to abut on the surface of the cleaning target member has no reformed layer, the abutment part may be worn greatly.

A Martens hardness of the surface of the reformed layer is from 1.5 $N/mm^2$ to 15 $N/mm^2$, and preferably from 3 $N/mm^2$ to 10 $N/mm^2$. When the Martens hardness of the surface of the reformed layer is less than 1.5 $N/mm^2$, the abutment part may easily ride up. When it is greater than 15 $N/mm^2$, the abutment part may have a poor followability and cause a cleaning failure.

The relationship H/L between a Martens hardness H in the region inward from the abutment part thicknesswise, and a distance L from the surface of the reformed layer indicates a relationship based on Martens hardnesses H measured at a plurality of positions in a region inward from the surface of the reformed layer thicknesswise, and distances L of the measurement positions from the surface of the reformed layer.

The values of from 0.010 ($N/mm^2 \cdot 1/\mu m$) to 0.2 ($N/mm^2 \cdot 1/\mu m$) in the range of H/L are obtained by dividing the maximum hardness among the Martens hardnesses measured at the plurality of positions by the thickness of the reformed layer, where the thickness of the reformed layer is a distance from the surface of the reformed layer, of a position that is the closest to the surface of the reformed layer, among positions at which the Martens hardnesses and elastic powers measured at the plurality of measurement positions are equal to the Martens hardness and elastic power of the elastic member.

That is, the distance L is the minimum distance among distances to the surface of the reformed layer, from positions at which a measured Martens hardness is equal to the Martens hardness of the elastic member, and a measured elastic power is equal to the elastic power of the elastic member.

Figure 8:
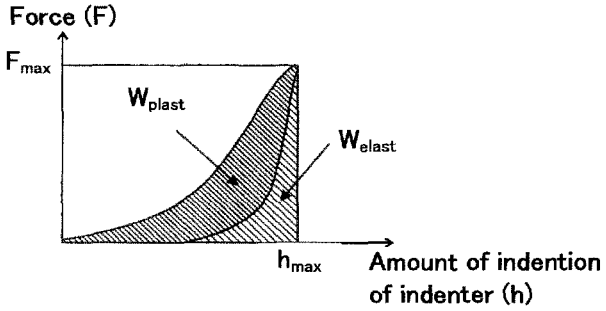
FIG. 8 is a diagram explaining an elastic power.

Elastic power is a characteristic value defined by a formula: Welast/Wplast×100% (see FIG. 8), where Wplast represents a cumulative stress when a Vickers indenter is indented, and Welast represents a cumulative stress when a test load is unloaded. A material having a higher elastic power has less hysteresis loss (less plastic deformation), i.e., a higher rubber property. A material having a very low elastic power is more glass than rubber. By analyzing not only Martens hardness but also elastic power, it is possible to calculate a more accurate distance L from the surface of the reformed layer.

As described above, the relationship H/L based on a Martens hardness H in a region inward from the surface of the reformed layer thicknesswise and a distance L from the surface of the reformed layer is calculated from a Martens hardness and the thickness of the reformed layer. Therefore, it indicates the distribution of hardness in the reformed layer. By controlling the distribution of hardness in the reformed layer, it is possible to secure both of a high hardness and followability in the abutment part to abut on the cleaning target member at the same time.

When the value H/L is less than 0.010 ($N/mm^2 \cdot 1/m$), the abutment part may easily ride up. When it is greater than 0.2 ($N/mm^2 \cdot 1/m$), the abutment part may have a poor followability and cause a cleaning failure.

Martens hardness at the surface of the reformed layer and in a region inward from the surface of the reformed layer thicknesswise can be measured with, for example, a microhardness tester HM-2000 manufactured by Fischer Instruments K.K.

With the elastic member having a reformed layer at the abutment part, with the Martens hardness at the surface of the reformed layer being from 1.5 $N/mm^2$ to 15 $N/mm^2$, and with the relationship H/L based on a Martens hardness H in a region inward from the abutment part thicknesswise and a distance L from the surface of the reformed layer being from 0.010 ($N/mm^2 \cdot 1/\mu m$) to 0.2 ($N/mm^2 \cdot 1/\mu m$), the hardness of the abutment part of the elastic member is enhanced, which makes it possible for the abutment part to be prevented from riding up or being deformed, and to have followability with respect to the cleaning target member. Furthermore, even if an internal portion of the abutment part is exposed due to wear of the abutment part over time, the abutment part that has been impregnated down to the internal portion can be likewise suppressed from riding up or being deformed.

It is preferable that the reformed layer contain a cured product of an ultraviolet-curable composition containing a (meth)acrylate compound. A usable example of the ultraviolet-curable composition containing a (meth)acrylate compound is a (meth)acrylate compound having a molecular weight of from 100 to 1,500.

The (meth)acrylate compound having a molecular weight of from 100 to 1,500 is not particularly limited, and an arbitrary one may be selected according to the purpose. Examples thereof include dipentaerythritol hexa(meth)acrylate, pentaerythritol tetra(meth)acrylate, pentaerythritol tri(meth)acrylate, pentaerythritol ethoxytetra(meth)acrylate, trimethylolpropane tri(meth)acrylate, trimethylolpropane ethoxytri(meth)acrylate, 1,6-hexanediol di(meth)acrylate, ethoxylated bisphenol A di(meth)acrylate, propoxylated ethoxylated bisphenol A di(meth)acrylate, 1,4-butanediol di(meth)acrylate, 1,5-pentanediol di(meth)acrylate, 1,6-hexanediol di(meth)acrylate, 1,7-heptanediol di(meth)acrylate, 1,8-octanediol di(meth)acrylate, 1,9-nonanediol di(meth)acrylate, 1,10-decanediol di(meth)acrylate, 1,11-undecanediol di(meth)acrylate, 1,18-octadecanediol di(meth)acrylate, glycerin propoxytri(meth)acrylate, dipropylene glycol di(meth)acrylate, tripropylene glycol di(meth)acrylate, PO-modified neopentyl glycol di(meth)acrylate, PEG600 di(meth)acrylate, PEG400 di(meth)acrylate, PEG200 di(meth)acrylate, neopentyl glycol-hydroxypivalic acid ester-di(meth)acrylate, octyl/decyl (meth)acrylate, isobornyl (meth)acrylate, ethoxylated phenyl (meth)acrylate, and 9,9-bis[4-(2-(meth)acryloyloxyethoxy)phenyl] fluorene. One of these may be used alone, or two or more of these may be used in combination. Among these, a compound having a pentaerythritol triacrylate structure having 3 to 6 functional groups is preferable.

Examples of the compound having a pentaerythritol triacrylate structure having 3 to 6 functional groups include pentaerythritol triacrylate, and dipentaerythritol hexaacrylate.

—(Meth)Acrylate Compound Having Alicyclic Structure Having 6 or More Carbon Atoms in Molecule Thereof—

A (meth)acrylate compound having an alicyclic structure having 6 or more carbon atoms in the molecule thereof has an atypical bulky alicyclic structure in the molecule thereof. Hence, it is possible to use a (meth)acrylate compound having a small number of functional groups and a low molecular weight, which can be easily impregnated into the abutment part of the elastic member, and can improve the hardness of the abutment part efficiently. Further, when a surface layer is formed over the abutment part, the material can prevent cracking and peeling of the surface layer.

The number of carbon atoms in the alicyclic structure of the (meth)acrylate compound having an alicyclic structure having 6 or more carbon atoms in the molecule thereof is preferably from 6 to 12, and more preferably from 8 to 10. When the number of carbon atoms is less than 6, the hardness of the abutment part may be poor. When it is greater than 12, the compound may have steric hindrance.

The number of functional groups of the (meth)acrylate compound having an alicyclic structure having 6 or more carbon atoms in the molecule thereof is preferably from 2 to 6, and more preferably from 2 to 4. When the number of functional groups is less than 2, the hardness of the abutment part may be poor. When it is greater than 6, the compound may have steric hindrance.

The molecular weight of the (meth)acrylate compound having an alicyclic structure having 6 or more carbon atoms in the molecule thereof is preferably 500 or less. When the molecular weight is greater than 500, it is harder for the compound to impregnate into the elastic member because of its large molecular size, making it hard to improve the hardness.

At least one selected from the group consisting of a (meth)acrylate compound having a tricyclodecane structure and a (meth)acrylate compound having an adamantane structure is preferable as the (meth)acrylate compound having an alicyclic structure having 6 or more carbon atoms in the molecule thereof, because such a compound can compensate for insufficiency of cross-linking points with its atypical cyclic structure despite its small number of functional groups.

The (meth)acrylate compound having a tricyclodecane structure is not particularly limited, and an arbitrary one may be selected according to the purpose. Examples thereof include tricyclodecane dimethanol diacrylate, and tricyclodecane dimethanol dimethacrylate.

The (meth)acrylate compound having a tricyclodecane structure may be an appropriately synthesized product or may be a commercially available product. Examples of the commercially available product include a product name: A-DCP (manufactured by Shin-Nakamura Chemical Co., Ltd.).

The (meth)acrylate compound having an adamantane structure is not particularly limited, and an arbitrary one may be selected according to the purpose. Examples thereof include 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

The (meth)acrylate compound having an adamantane structure may be an appropriately synthesized product or may be a commercially available product. Examples of the commercially available product include a product name: X-DA (manufactured by Idemitsu Kosan Co., Ltd.), a product name: X-A-201 (manufactured by Idemitsu Kosan Co., td.), and a product name: ADTM (manufactured by Mitsubishi Gas Chemical Company, Inc.).

The content of the (meth)acrylate compound having an alicyclic structure having 6 or more carbon atoms in the molecule thereof is not particularly limited, and may be appropriately selected according to the purpose. It is preferably from 20% by mass to 100% by mass, and more preferably from 50% by mass to 100% by mass, relative to the ultraviolet-curable composition. When the content is less than 20% by mass, improvement of the hardness based on the atypical cyclic structure may be spoiled.

It is possible to analyze with, for example, an infrared microscope, or liquid chromatography whether the (meth) acrylate compound having an alicyclic structure having 6 or more carbon atoms in the molecule thereof (preferably, a (meth)acrylate compound having a tricyclodecane structure or a (meth)acrylate compound having an adamantane structure) is contained in the abutment part of the elastic member to abut on the surface of the cleaning target member.

The ultraviolet-curable composition may contain any other (meth)acrylate compound having a molecular weight of from 100 to 1,500, than the (meth)acrylate compound having an alicyclic structure having 6 or more carbon atoms in the molecule thereof. The (meth)acrylate compound having a molecular weight of from 100 to 1,500 is not particularly limited, and an arbitrary one may be selected according to the purpose. Examples thereof include the compounds listed as the examples of the (meth)acrylate compound having a molecular weight of from 100 to 1,500 described above. One of these may be used alone or two or more of these may be used in combination. Among these, a compound having a pentaerythritol triacrylate structure having 3 to 6 functional groups is preferable.

Examples of the compound having a pentaerythritol triacrylate structure having 3 to 6 functional groups include pentaerythritol triacrylate, and dipentaerythritol hexaacrylate.

<Other Components>

Other components are not particularly limited, and arbitrary components may be selected according to the purpose. Examples thereof include a photopolymerization initiator, a polymerization inhibitor, and a diluent.

—Photopolymerization Initiator—

The photopolymerization initiator is not particularly limited, and an arbitrary photopolymerization initiator may be selected according to the purpose as long as it produces active species such as radicals and cations in response to photo energy and initiates polymerization. Examples thereof include a photo-radical polymerization initiator, and a photo-cationic polymerization initiator. Of these, a photo-radical polymerization initiator is particularly preferable.

Examples of the photo-radical polymerization initiator include aromatic ketones, an acylphosphine oxide compound, an aromatic onium salt compound, an organic peroxide, a thio compound (e.g., a thioxanthone compound, and a thiophenyl group-containing compound), a hexaaryl biimidazole compound, a ketooxime ester compound, a borate compound, an azinium compound, a metallocene compound, an active ester compound, a compound containing a carbon-halogen bond, and an alkylamine compound.

The photo-radical polymerization initiator is not particularly limited, and an arbitrary photo-radical polymerization initiator may be selected according to the purpose. Examples thereof include acetophenone, acetophenone benzyl ketal, 1-hydroxycyclohexyl phenyl ketone, 2,2-dimethoxy-2-phenylacetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler ketone, benzoin propyl ether, benzoin ethyl ether, benzyl dimethyl ketal, 1-(4-isopropylphenyl)-2-hydroxy-2-methylpropan-1-one, 2-hydroxy-2-methyl-1-phenylpropan-1-one, thioxanthone, diethyl thioxanthone, 2-isopropyl thioxanthone, 2-chlorothioxanthone, 2-methyl-1-[4-(methylthio)phenyl]-2-morpholino-propan-1-one, bis(2,4,6-trimethylbenzoyl)-phenylphosphine oxide, 2,4,6-trimethylbenzoyl-diphenyl-phosphine oxide, 2,4-diethyl thioxanthone, and bis-(2,6-dimethoxybenzoyl)-2,4,4-trimethylpentyl phosphine oxide. One of these may be used alone, or two or more of these may be used in combination.

The photo-radical polymerization initiator may be a commercially available product. Examples of commercially available products include: IRGACURE 651, IRGACURE 184, DAROCUR 1173, IRGACURE 2959, IRGACURE 127, IRGACURE 907, IRGACURE 369, IRGACURE 379, DAROCUR TPO, IRGACURE 819, IRGACURE 784, IRGACURE OXE 01, IRGACURE OXE 02, and IRGACURE 754 (all manufactured by Ciba Specialties Chemicals Corporation); SPEEDCURE TPO (manufactured by Lambson Japan Co., Ltd.); KAYACURE DETX-S (manufactured by Nippon Kayaku Co., Ltd.); LUCIRIN TPO, LR8893, and LR8970 (all manufactured by BASF Corporation); and EBECRYL 8405 (manufactured by UCB Japan Co., Ltd.). One of these may be used alone, or two or more of these may be used in combination.

The content of the photopolymerization initiator is not particularly limited, and may be appropriately selected according to the purpose. However, it is preferably from 1% by mass to 20% by mass relative to the ultraviolet-curable composition.

—Polymerization Inhibitor—

The polymerization inhibitor is not particularly limited, and an arbitrary polymerization inhibitor may be selected according to the purpose. Examples thereof include: phenol compounds such as p-methoxyphenol, cresol, t-butylcatechol, di-t-butylparacresol, hydroquinone monomethyl ether, α-naphthol, 3,5-di-t-butyl-4-hydroxytoluene, 2,2'- methylenebis(4-methyl-6-t-butylphenol), 2,2'-methylenebis (4-ethyl-6-butylphenol), and 4,4'-thiobis(3-methyl-6-t-butylphenol); quinone compounds such as p-benzoquinone, anthraquinone, naphthoquinone, phenanthraquinone, p-xyloquinone, p-toluquinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-di-butylhydroquinone, mono-t-butylhydroquinone, monomethylhydroquinone, and 2,5-di-t-amylhydroquinone; amine compounds such as phenyl-β-naphthylamine, p-benzylaminophenol, di-β-naphthyl paraphenylene diamine, dibenzyl hydroxyl amine, phenyl hydroxyl amine, and diethyl hydroxyl amine; nitro compounds such as dinitrobenzene, trinitrotoluene, and picric acid; oxime compounds such as quinone dioxime, and cyclohexanone oxime; and sulfur compounds such as phenothiazine. One of these may be used alone, or two or more of these may be used in combination.

—Diluent—

The diluent is not particularly limited, and an arbitrary diluent may be selected according to the purpose. Examples thereof include: hydrocarbon-based solvents such as toluene and xylene; ester-based solvents such as ethyl acetate, n-butyl acetate, methylcellosolve acetate, and propylene glycol monomethyl ether acetate; ketone-based solvents such as acetone, methyl ethyl ketone, methyl isobutyl ketone, diisobutyl ketone, cyclohexanone, and cyclopentanone; ether-based solvents such as tetrahydrofuran, ethylene glycol monomethyl ether, ethylene glycol monoethyl ether, and propylene glycol monomethyl ether; and alcohol-based solvents such as ethanol, propanol, 1-butanol, isopropyl alcohol, and isobutyl alcohol. One of these may be used alone, or two or more of these may be used in combination.

The irradiation conditions of ultraviolet rays used for curing the ultraviolet-curable composition are not particularly limited, and may be appropriately selected according to the purpose. However, an accumulated light intensity of from 500 mJ/cm$^2$ to 5,000 mJ/cm$^2$ is preferable.

The cleaning blade of the present invention can suppress the abutment part of the elastic member thereof to abut on the surface of a cleaning target member from riding up, has little wear over the abutment part of the elastic member during use, and can maintain favorable cleaning performance for a long term. Therefore, it can be used widely in various fields. However, it is particularly preferable to use the cleaning blade for an image forming apparatus, an image forming method, and a process cartridge of the present invention described below.

(Image Forming Apparatus and Image Forming Method)

An image forming apparatus of the present invention includes at least an image bearing member, a charging unit, an exposing unit, a developing unit, a transfer unit, a fixing unit, and a cleaning unit, and further includes other units appropriately selected according to necessity. The charging unit and the exposing unit may be referred to collectively as an electrostatic latent image forming unit.

An image forming method used in the present invention includes at least a charging step, an exposing step, a developing step, a transfer step, a fixing step, and a cleaning step, and further includes other steps appropriately selected according to necessity. The charging step and the exposing step may be referred to collectively as an electrostatic latent image forming step.

The image forming method used in the present invention can be preferably performed by the image forming apparatus of the present invention. The charging step can be performed by the charging unit. The exposing step can be performed by the exposing unit. The developing step can be performed by the developing unit. The transfer step can be performed by the transfer unit. The fixing step can be performed by the fixing unit. The cleaning step can be performed by the cleaning unit. The other steps can be performed by the other units.

<Image Bearing Member>

The material, shape, structure, size, etc. of the image bearing member (hereinafter may be referred to as "electrophotographic photoconductor" or "photoconductor") are not particularly limited. An arbitrary image bearing member may be selected from publicly-known ones. In terms of shape, it may have a drum shape, a belt shape, etc. In terms of material, it may be an inorganic photoconductor made of amorphous silicone, selenium, etc., or an organic photoconductor (OPC) made of polysilane, phthalopolymethine, etc.

<Charging Step and Charging Unit>

The charging step is a step of electrically charging the surface of the image bearing member, and performed by the charging unit.

The charging can be performed by, for example, applying a voltage to the surface of the image bearing member, with the charging unit.

The charging unit is not particularly limited, and an arbitrary charging unit may be selected according to the purpose. Examples thereof include a contact charger publicly-known per se that includes an electroconductive or semiconductive roller, brush, film, rubber blade, etc., and a contactless charger utilizing a corona discharge such as a corotron and a scrotron.

In terms of shape, the charging unit may have any form such as a roller, a magnetic brush, and a fur brush, and the shape thereof can be selected according to the specifications and form of an electrophotographic image forming apparatus. When it is a magnetic brush, the magnetic brush is composed of a charging medium which is particles of any ferrite such as Zn—Cu ferrite, a nonmagnetic electroconductive sleeve to support the charging medium, and a magnet roll embraced in the sleeve. When it is a brush, the material of, for example, a fur brush may be a fur treated with carbon, copper sulfide, a metal, or a metal oxide to have electroconductivity. This fur may be wound around or bonded to a cored bar treated with a metal or any other material to have electroconductivity. This may be used as a charger.

The charger is not limited to such a contact charger as described above. However, a contact charger is advantageous in that an image forming apparatus with less ozone emissions from the charger can be obtained.

It is preferable that the charger be disposed in or out of contact with the image bearing member, and configured to electrically charge the surface of the image bearing member by applying direct and alternating currents in a superposed state.

It is also preferable that the charger be a charging roller disposed in proximity of the image bearing member contactlessly with a gap tape, and configured to electrically charge the surface of the image bearing member by having direct and alternating currents applied thereto in a superposed state.

<Exposing Step and Exposing Unit>

The exposing step is a step of exposing the electrically charged surface of the image bearing member to light, and performed by the exposing unit.

The exposing can be performed by, for example, exposing the surface of the image bearing member to light imagewise, with the exposing unit.

An optical system involved in the exposing is roughly divided into an analog optical system and a digital optical system. The analog optical system is an optical system configured to project a document onto the image bearing member directly through the optical system. The digital optical system is an optical system supplied with image information in the form of an electric signal, and configured to convert the signal to an optical signal, expose an electrophotographic photoconductor to light, and form an image thereon.

The exposing unit is not particularly limited, and an arbitrary exposing unit may be selected according to the purpose, as long as it can expose the surface of the image bearing member electrically charged by the charging unit to light imagewise like the image to be formed. Examples thereof include various exposing devices such as a copier optical system, a rod lens array system, a laser light optical system, a liquid crystal shutter optical system, and a LED optical system.

In the present invention, a backlighting system configured to expose the image bearing member to light from the back side of the image bearing member may also be employed.

<Developing Step and Developing Unit>

The developing step is a step of developing the electrostatic latent image with a toner and form a visible image.

The formation of the visible image can be performed by, for example, developing the electrostatic latent image with a toner, and can be performed by the developing unit.

The developing unit is not particularly limited, and an arbitrary developing unit may be selected from publicly-known ones as long as it can perform development using a toner. A preferable example of the developing unit is a developing unit including at least a developing device that contains a toner, and is capable of supplying the toner to the electrostatic latent image in a contact manner or contactlessly.

The developing device may be a dry developing system or a wet developing system, or may be a single-color developing device or a multi-color developing device. A preferable example of the developing device is a developing device including a stirrer configured to frictionally stir and thereby electrically charge the toner, and a magnet roller that can rotate.

In the developing device, for example, the toner, and according to necessity, a carrier are mixed and stirred. Due to friction during the mixing and stirring, the toner gets electrically charged, and retained on the surface of the rotating magnet roller in a chain-like form, forming a magnetic brush. Because the magnet roller is disposed near the image bearing member, the toner constituting the magnetic brush formed on the surface of the magnet roller is partially moved to the surface of the image bearing member by an electric attractive force. As a result, the electrostatic latent image is developed with the toner, and a visible image formed of the toner is formed on the surface of the image bearing member.

The toner contained in the developing device may be a developer containing the toner. The developer may be a one-component developer or a two-component developer.

—Toner—

The toner contains toner base particles and external additives, and further contains other components according to necessity.

The toner may be a monochrome toner or a color toner.

The toner base particles contain at least a binder resin and a colorant, and further contain other components such as a releasing agent and a charge controlling agent according to necessity.

—Binder Resin—

The binder resin is not particularly limited, and an arbitrary binder resin may be selected according to the purpose. Examples thereof include a homopolymer of styrene such as a polystyrene resin and a polyvinyl toluene resin or of a substitution product of styrene, a styrene-p-chlorostyrene copolymer, a styrene-propylene copolymer, a styrene-vinyltoluene copolymer, styrene-methyl acrylate copolymer, a styrene-ethyl acrylate copolymer, a styrene-butyl acrylate copolymer, a styrene-methyl methacrylate copolymer, a styrene-ethyl methacrylate copolymer, a styrene-butyl methacrylate copolymer, styrene-α-methyl chloromethacrylate copolymer, a styrene-acrylonitrile copolymer, a styrene-vinyl methyl ether copolymer, a styrene-vinyl methyl ketone copolymer, a styrene-butadiene copolymer, a styrene-isoprene copolymer, a styrene-maleic acid copolymer, a styrene-maleic acid ester copolymer, polymethyl methacrylate, polybutyl methacrylate, a polyvinyl chloride resin, a polyvinyl acetate resin, a polyethylene resin, a polypropylene resin, a polyester resin, a polyurethane resin, an epoxy resin, a polyvinyl butyral resin, a polyacrylic acid resin, rosin, modified rosin, a terpene resin, a phenol resin, aliphatic hydrocarbon, an aromatic petroleum resin, chlorinated paraffin, and a paraffin wax. One of these may be used alone, or two or more of these may be used in combination. Among these, a polyester resin is particularly preferable compared with a styrene-based resin and an acrylic-based resin, because it can impart a low melt viscosity to the toner while securing storage stability of the toner.

The polyester resin can be obtained from a polycondensation reaction between, for example, an alcohol component and a carboxylic acid component.

The alcohol component is not particularly limited, and an arbitrary alcohol component may be selected according to the purpose. Examples thereof include: diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, polyoxyethylenated bisphenol A, and polyoxypropylenated bisphenol A; a dihydric alcohol unit obtained by substituting a saturated or unsaturated hydrocarbon group having 3 to 22 carbon atoms for those above; and a trihydric or higher polyhydric alcohol unit such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethyl benzene.

The carboxylic acid component is not particularly limited, and an arbitrary carboxylic acid component may be selected according to the purpose. Examples thereof include: a monocarboxylic acid such as a palmitic acid, a stearic acid, and an oleic acid; a maleic acid, a fumaric acid, a mesaconic acid, a citraconic acid, a terephthalic acid, a cyclohexane dicarboxylic acid, a succinic acid, an adipic acid, a sebacic acid, a moronic acid, a divalent organic acid monomer obtained by substituting a saturated or unsaturated hydrocarbon group having 3 to 22 carbon atoms for these acids, anhydrides of these acids, and a dimer acid of lower alkyl ester and a linoleic acid; and 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 3,3-dicarboxymethyl butanoic acid, tetracarboxymethyl methane, 1,2,7,8-octane tetracarboxylic acid enpol trimer acid, and a trivalent or higher polyvalent carboxylic acid monomer of anhydrides of these acids.

—Colorant—

The colorant is not particularly limited, and an arbitrary colorant may be selected from publicly-known dyes and pigments according to the purpose. Examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 6B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. One of these may be used alone, or two or more of these may be used in combination.

The content of the colorant in the toner is not particularly limited, and may be appropriately selected according to the purpose. However, it is preferably from 1% by mass to 15% by mass, and more preferably from 3% by mass to 10% by mass.

The colorant may be used in the form of a master batch in which it is combined with a resin. The resin is not particularly limited, and an arbitrary resin may be selected from publicly-known resins according to the purpose. Examples thereof include a polymer of styrene or of a substitution product of styrene, a styrene-based copolymer, a polymethyl methacrylate resin, a polybutyl methacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, a polyacrylic acid resin, rosin, modified rosin, a terpene resin, an aliphatic hydrocarbon resin, an alicyclic hydrocarbon resin, an aromatic petroleum resin, chlorinated paraffin, and paraffin. One of these may be used alone, or two or more of these may be used in combination.

—Releasing Agent—

The releasing agent is not particularly limited, and an arbitrary releasing agent may be selected according to the purpose. Examples thereof include waxes.

Examples of the waxes include a carbonyl group-containing wax, a polyolefin wax, and long-chain hydrocarbon. One of these may be used alone, or two or more of these may be used in combination. Among these, a carbonyl group-containing wax is preferable.

Examples of the carbonyl group-containing wax include polyalkane acid ester, polyalkanol ester, polyalkane acid amide, polyalkyl amide, and dialkyl ketone. Examples of the polyalkane acid ester include a carnauba wax, a montan wax, trimethylolpropane tribehenate, pentaerythritol tetrabehenate, pentaerythritol diacetate dibehenate, glycerin tribehenate, and 1,18-octadecanediol distearate. Examples of the polyalkanol ester include tristearyl trimellitate, and distearyl maleate. Examples of the polyalkane acid amide include dibehenyl amide. Examples of the polyalkyl amide include tristearylamide trimellitate. Examples of the dialkyl ketone include distearyl ketone. Among these carbonyl group-containing waxes, polyalkane acid ester is particularly preferable.

Examples of the polyolefin wax include a polyethylene wax, and a polypropylene wax.

Examples of the long-chain hydrocarbon include a paraffin wax, and a Sasol wax.

The content of the releasing agent in the toner is not particularly limited, and may be appropriately selected according to the purpose. However, it is preferably from 5% by mass to 15% by mass.

—Charge Controlling Agent—

The charge controlling agent is not particularly limited, and an arbitrary charge controlling agent may be selected according to the purpose. Examples thereof include a nigrosin-based dye, a triphenylmethane-based dye, a chromium-containing metal complex dye, a molybdic acid chelate pigment, a rhodamine-based dye, alkoxy-based amine, a quaternary ammonium salt (including a fluorine-modified quaternary ammonium salt), alkylamide, phosphorus or a phosphorus compound, tungsten or a tungsten compound, a fluorosurfactant, a metal salt of a salicylic acid, and a metal salt of a salicylic acid derivative.

The content of the charge controlling agent is not particularly limited, and may be appropriately selected according to the purpose. However, it is preferably from 0.1 parts by mass to 10 parts by mass, and more preferably from 0.2 parts by mass to 5 parts by mass, relative to 100 parts by mass of the toner.

—External Additives—

The external additives are not particularly limited, and arbitrary external additives may be selected according to the purpose as long as they include at least silica particles. The external additives may further include: inorganic particles of silica, titanium oxide, alumina, silicon carbide, silicon nitride, and boron nitride; and resin particles obtained by a soap-free emulsion polymerization method and having an average particle diameter of from 0.05 μm to 1 μm, such as polymethyl methacrylate particles and polystyrene particles. One of these may be used alone, or two or more of these may be used in combination. Among these, silica of which surface is treated to have hydrophobicity is particularly preferable.

Examples of the silica include a silicone-treated silica. A silicone-treated silica is a silica of which surface is subjected to surface treatment (hydrophobization) with a silicone oil.

The method for the surface treatment is not particularly limited, and an arbitrary method may be selected according to the purpose.

Examples of the silicone oil include a dimethyl silicone oil, a methyl hydrogen silicone oil, and a methyl phenyl silicone oil.

The silicone-treated silica may be a commercially available product. Examples of commercially available products include RY200, R2T200S, NY50, and RY50 (all manufactured by Nippon Aerosil Co., Ltd.), and others.

—Other Components—

The other components in the toner are not particularly limited, and arbitrary components may be selected according to the purpose. Examples thereof include a flow improver, a cleaning performance improver, a magnetic material, and a metal soap.

The flow improver can prevent degradation of a flow property and a charging property of the toner even under high-humidity conditions, by enhancing hydrophobicity of the toner by surface treatment. Examples of the flow improver include a silane coupling agent, a silylation agent, a silane coupling agent containing an alkyl fluoride group, an organic titanate-based coupling agent, an aluminum-based coupling agent, a silicone oil, and a modified silicone oil.

The cleaning performance improver is added in the toner in order for toner, which remains on the image bearing member or an intermediate transfer medium after transfer, to be removed. Examples of the cleaning performance improver include: a metal salt of a fatty acid such as zinc stearate, calcium stearate, and a stearic acid; and polymer particles produced by soap-free emulsion polymerization, such as polymethyl methacrylate particles and polystyrene particles. It is preferable that the polymer particles have a relatively narrow particle size distribution, and a preferable volume average particle diameter thereof is from 0.01 μm to 1 μm.

The magnetic material is not particularly limited, and an arbitrary magnetic material may be selected according to the purpose. Examples thereof include an iron powder, magnetite, and ferrite. Among these, a white material is preferable in terms of color tone.

—Toner Production Method—

The method for producing the toner is not particularly limited, and an arbitrary method may be selected from conventionally publicly-known toner production methods. Examples thereof include a kneading/pulverization method, a polymerization method, a dissolution suspension method, and a spray granulation method. Among these, polymerization methods such as a suspension polymerization method, an emulsion polymerization method, and a dispersion polymerization method are preferable, because it is easy to achieve a high circularity and a small particle diameter and thereby improve the image quality, with these methods.

—Kneading/Pulverization Method—

The kneading/pulverization method is a method of producing base particles of the toner by melt-kneading toner materials including, for example, at least a binder resin and a colorant, and pulverizing and classifying the obtained kneaded product.

In the melt-kneading, the toner materials are mixed, and the mixture is placed in a melt kneader and melt-kneaded. The melt-kneader may be, for example, a uniaxial or biaxial continuous kneader, or a batch-type kneader using a roll mill. Preferable examples of the melt-kneader include a KTK-type biaxial extruder manufactured by Kobe Steel. Ltd., a TEM-type extruder manufactured by Toshiba Machine Co., Ltd., a biaxial extruder manufactured by KCK Corporation, a PCM-type biaxial extruder manufactured by Ikegai Corp., and a co-kneader manufactured by Buss Inc. It is preferable to perform this melt-kneading under adequate conditions that would not cause the molecular chains of the binder resin to be disconnected. Specifically, the melt-kneading temperature is determined with reference to a softening point of the binder resin. When the temperature is much higher than the softening point, disconnections will be severe. When the temperature is much lower than the softening point, dispersion may not advance.

In the pulverization, the kneaded product obtained from the melt-kneading is pulverized. In this pulverization, it is it is preferable to coarsely pulverize the kneaded product first, and then finely pulverize it next. For this purpose, it is preferable to use a method of pulverizing the kneaded product by letting it collide against an impact board in a jet stream, or pulverizing the kneaded product by letting the particles thereof collide against each other in a jet stream, and mechanically pulverizing the particles in a narrow gap between a rotating rotor and a stator.

In the classification, the pulverized product obtained from the pulverization is classified and adjusted to particles having a predetermined particle diameter. The classification can be performed by removing fine particles with, for example, a cyclone, a decanter, and a centrifuge.

After the pulverization and the classification are completed, the pulverized product is classified with a centrifugal force or the like in a gas stream, whereby toner base particles having a predetermined particle diameter can be produced.

Next, the external additives are externally added over the toner base particles. The toner base particles and the external additives are mixed and stirred with a mixer, whereby the external additives are coated over the surface of the toner base particles while being pulverized. In this case, in terms of durability, it is important to make the external additives such as silica particles adhere to the toner base particles uniformly and firmly.

—Polymerization Method—

In a method for producing a toner by the polymerization method, for example, toner materials including: a modified polyester-based resin that would form a urea bond, a urethane bond, or both thereof and a colorant are dissolved or dispersed in an organic solvent. Then, this dissolved or dispersed product is dispersed in an aqueous medium, and let to undergo a polyaddition reaction. Then, the solvent is removed from the obtained dispersion liquid, and the resultant is washed, whereby a toner is obtained.

An example of the modified polyester-based resin that would form a urea bond or a urethane bond is an isocyanate group-containing polyester prepolymer that is obtained by reacting a carboxyl group, a hydroxyl group, or the like at the terminal of polyester, with a polyvalent isocyanate compound (PIC). A modified polyester resin obtained by reacting this polyester prepolymer with an amine or the like to let the molecular chains be cross-linked, elongated, or cross-linked and elongated, can improve a hot offset property of a toner while maintaining low temperature fixability of the toner.

Examples of the polyvalent isocyanate compound (PIC) include: aliphatic polyvalent isocyanate (e.g., tetramethylene diisocyanate, hexamethylene diisocyanate, and 2,6-diisocyanatomethyl caproate); alicyclic polyisocyanate (e.g., isophorone diisocyanate, and cyclohexylmethane diisocyanate); aromatic diisocyanate (e.g., tolylene diisocyanate, and diphenylmethane diisocyanate); aromatic aliphatic diisocyanate (e.g., α,α,α',α'-tetramethylxylylene diisocyanate); isocyanates; and a product obtained by blocking the polyisocyanate with a phenol derivative, oxime, caprolactam, or the like. One of these may be used alone, or two or more of these may be used in combination.

The ratio of the polyvalent isocyanate compound (PIC) is not particularly limited, and may be appropriately selected according to the purpose. However, an equivalent ratio [NCO]/[OH] of isocyanate groups [NCO] to hydroxyl groups [OH] of the polyester containing hydroxyl groups is preferably from 5/1 to 1/1, more preferably from 4/1 to 1.2/1, and yet more preferably from 2.5/1 to 1.5/1.

The number of isocyanate groups contained per molecule of an isocyanate group-containing polyester prepolymer (A) is not particularly limited, and may be appropriately selected according to the purpose. However, it is preferably 1 or more, more preferably from 1.5 to 3 on average, and yet more preferably from 1.8 to 2.5 on average.

Examples of the amine (B) to be reacted with the polyester prepolymer include a divalent amine compound (B1), a trivalent or higher polyvalent amine compound (B2), an amino alcohol (B3), amino mercaptan (B4), an amino acid (B5), and a product (B6) obtained by blocking an amino group of B1 to B5.

Examples of the divalent amine compound (B1) include: an aromatic diamine (e.g., phenylene diamine, diethyltoluene diamine, and 4,4'-diamino diphenyl methane); an alicyclic diamine (e.g., 4,4'-diamino-3,3'-dimethyl dicyclohexyl methane, diamine cyclohexane, and isophorone diamine); and an aliphatic diamine (e.g., ethylene diamine, tetramethylene diamine, and hexamethylene diamine).

Examples of the trivalent or higher polyvalent amine compound (B2) include diethylene triamine, and triethylene tetramine.

Examples of the amino alcohol (B3) include ethanol amine, and hydroxyethyl aniline.

Examples of the amino mercaptan (B4) include aminoethyl mercaptan, and aminopropyl mercaptan.

Examples of the amino acid (B5) include an amino propionic acid, and an amino caproic acid.

Example of the product (B6) obtained by blocking an amino group of B1 to B5 described above include a ketimine compound obtained from an amine of B1 to B5 and a ketone (e.g., acetone, methyl ethyl ketone, and methyl isobutyl ketone), and an oxazolidine compound. Among these amines (B), B1, and a mixture of B1 with a small amount of B2 are particularly preferable.

The ratio of the amine (B) is not particularly limited, and may be appropriately selected according to the purpose. However, an equivalent ratio [NCO]/[NHx] of isocyanate groups [NCO] in the isocyanate group-containing polyester prepolymer (A) to amino groups [NHx] in the amine (B) is preferably from 1/2 to 2/1, more preferably from 1.5/1 to 1/1.5, and yet more preferably from 1.2/1 to 1/1.2.

According to the toner production method by the polymerization method described above, it is possible to produce a toner having a small particle diameter and a spherical shape, with low environmental impact and at a low cost.

A disperser for the dispersion is not particularly limited, and an arbitrary disperser may be selected according to the purpose. Examples thereof include a low-speed shearing disperser, a high-speed shearing disperser, a friction disperser, a high-pressure jet disperser, and an ultrasonic disperser.

Among these, a high-speed shearing disperser is preferable, because it can control a resulting dispersion (oil droplets) to a particle diameter of from 2 μm to 20 μm.

When using a high-speed shearing disperser, it is possible to appropriately select conditions such as a rotation speed, a dispersion time, a dispersion temperature, etc. according to the purpose.

The rotation speed is not particularly limited, and may be appropriately selected according to the purpose. However, it is preferably from 1,000 rpm to 30,000 rpm, and more preferably from 5,000 rpm to 20,000 rpm.

The dispersion time is not particularly limited, and may be appropriately selected according to the purpose. However, in the case of a bath-type disperser, it is preferably from 0.1 minutes to 5 minutes.

The dispersion temperature is not particularly limited, and may be appropriately selected according to the purpose. However, under pressurized conditions, it is preferably from 0° C. to 150° C., and more preferably from 40° C. to 98° C. Generally, dispersion easily advances when the dispersion temperature is rather a high temperature.

The amount of the aqueous medium to be used when the toner materials are dispersed in the aqueous medium is not particularly limited, and may be appropriately selected according to the purpose. However, it is preferably from 50 parts by mass to 2,000 parts by mass, and more preferably from 100 parts by mass to 1,000 parts by mass, relative to 100 parts by mass of the toner materials.

A method for removing the organic solvent from the dispersion liquid is not particularly limited, and an arbitrary method may be selected according to the purpose. Examples thereof include a method of raising the temperature of the whole reaction system gradually, and vaporizing the organic solvent in the oil droplets, and a method of spraying the dispersion liquid in a dry atmosphere, and removing the organic solvent in the oil droplets.

When the organic solvent is removed, toner base particles are produced. The toner base particles may be washed, dried, and further classified. The classification may be performed by removing fine particles in a liquid with a cyclone, a decanter, a centrifuge, or the like, or may be performed after drying.

The obtained toner base particles may be mixed with the external additives, and according to necessity, with particles of the charge controlling agent, etc. In the mixing, a mechanical impact may be applied to the materials, which makes it possible to suppress the particles of the external additives, etc. from being detached from the surface of the toner base particles.

A method for applying the mechanical impact is not particularly limited, and an arbitrary method may be selected according to the purpose. Examples thereof include a method of applying an impact to the mixture with a blade rotating at a high speed, and a method of subjecting the mixture to a high-speed gas stream, and accelerating the mixture to let the particles collide against each other or let the particles collide against an appropriate impact board.

Equipment used for this method is not particularly limited, an arbitrary equipment may be selected according to the purpose. Examples thereof include an angmill (manufactured by Hosokawa Micron Corporation), an I-type mill (manufactured by Nippon Pneumatic Mfg. Co., Ltd.) remodeled to a lower pulverization air pressure, a hybridization system (manufactured by Nara Machinery Co., Ltd.), a kryptron system (manufactured by Kawasaki Heavy Industries, Ltd.), and an automatic mortar.

The average circularity of the toner is not particularly limited, and may be appropriately selected according to the purpose. However, it is preferably 0.97 or greater, and more preferably from 0.97 to 0.98. When the average circularity is less than 0.97, it may not be possible to obtain a satisfactory transferability and a high-quality image having no dust particles.

The average circularity of the toner can be measured with, for example, a flow-type particle image analyzer FPIA-1000 manufactured by Sysmex Corporation.

The volume average particle diameter of the toner is not particularly limited, and may be appropriately selected. However, it is preferably 5.5 μm or less.

A ratio (Dv/Dn) of the volume average particle diameter (Dv) to a number average particle diameter (Dn) is not particularly limited, and may be appropriately selected according to the purpose. However, it is preferably from 1.00 to 1.40. A ratio (Dv/Dn) closer to 1.00 means a shaper particle size distribution. A toner having such a small particle diameter and a narrow particle size distribution has a uniform charge buildup distribution and makes it possible to obtain a high-quality image with little background fogging, and can have a high transferability in an electrostatic transfer system.

When measured with a measuring instrument for measuring a particle size distribution of toner particles according to a Coulter counter method, the volume average particle diameter and the particle size distribution of the toner can be measured with, for example, COULTER COUNTER TA-II, or COULTER MULTISIZER II (both manufactured by Beckman Coulter Inc.).

The toner can be mixed with a magnetic carrier and used as a two-component developer. In this case, the mass ratio between the carrier and the toner in the two-component developer is not particularly limited, and may be appropriately selected according to the purpose. However, it is preferably from 1 part by mass to 10 parts by mass of the toner to 100 parts by mass of the carrier.

Examples of the magnetic carrier include an iron powder, a ferrite powder, a magnetite powder, and a magnetic resin carrier having a particle diameter of from about 20 μm to 200 μm.

Further, an electroconductive powder or the like may be contained in a coating resin, if necessary. Examples of the electroconductive powder include a metal powder, carbon black, titanium oxide, tin oxide, and zinc oxide. A preferable average particle diameter of the electroconductive powder is 1 μm or less. When the average particle diameter is greater than 1 μm, it may be difficult to control electric resistance.

The toner may be used as a one-component magnetic or nonmagnetic toner free from a carrier.

The coating resin is not particularly limited, and an arbitrary coating resin may be selected according to the purpose. Examples thereof include: halogenated olefin resins such as a urea-formaldehyde resin, a melamine resin, a benzoguanamine resin, a urea resin, a polyamide resin, an epoxy resin, a polyvinyl and polyvinylidene-based resin, an acrylic resin, a polymethyl methacrylate resin, a polyacrylonitrile resin, a polyvinyl acetate resin, a polyvinyl alcohol resin, a polyvinyl butyral resin, a polystyrene resin, a styrene-acrylic copolymer resin, and polyvinyl chloride; polyester-based resins such as a polyethylene terephthalate resin, and a polybutylene terephthalate resin; polycarbonate-based resins; a polyethylene resin; a polyvinyl fluoride resin; a polyvinylidene fluoride resin; a polytrifluoroethylene resin; a polyhexafluoropropylene resin; a copolymer between vinylidene fluoride and an acrylic monomer; a copolymer between vinylidene fluoride and vinyl fluoride; a fluoroterpolymer such as a terpolymer among tetrafluoroethylene, vinylidene fluoride, and a nonfluorinated monomer; and a silicone resin.

<Transfer Step and Transfer Unit>

The transfer step is a step of transferring the visible image onto a recording medium. It is preferable to use an intermediate transfer medium, and firstly transfer the visible image onto the intermediate transfer medium, and then secondly transfer the visible image onto a recording medium. It is more preferable to use two colors or more toners, preferably toners for full-colors, and perform a first transfer step of transferring a visible image onto an intermediate transfer medium and form a composite transfer image, and a second transfer step of transferring the composite transfer image onto a recording medium.

The transferring can be performed by, for example, electrically charging the image bearing member with a transfer unit and transferring the visible image, and can be performed by the transfer unit. A preferable form of the transfer unit is one that includes a first transfer unit configured to transfer visible images onto the intermediate transfer medium and form a composite transfer image, and a second transfer unit configured to transfer the composite transfer image onto a recording medium.

The intermediate transfer medium is not particularly limited, and an arbitrary intermediate transfer medium may be selected from publicly-known transfer media according to the purpose. Examples thereof include a transfer belt.

It is preferable that the transfer unit (the first transfer unit and the second transfer unit) include at least a transfer device configured to electrically charge the visible image formed on the image bearing member to be peeled toward the recording medium. There may be one transfer unit, or two or more. Examples of the transfer device include a corona transfer device using a corona discharge, a transfer belt, a transfer roller, a pressure transfer roller, and an adhesive transfer device.

A representative example of the recording medium is regular paper. However, the recording medium is not particularly limited, and an arbitrary recording medium may be selected according to the purpose, as long as it can have an unfixed developed image transferred thereto. A PET base for OHP, etc. can also be used as the recording medium.

<Fixing Step and Fixing Unit>

The fixing step is a step of fixing a toner image transferred onto a recording medium thereon, and can be performed with the transfer unit. When two colors or more toners are used, fixing may be performed each time a toner of any color is transferred onto a recording medium, or fixing may be performed when toners of all colors are transferred and overlaid on the recording medium. The fixing unit is not particularly limited, and a thermal fixing system using a publicly-known heating/pressurizing unit may be employed as the fixing unit. Examples of the heating/pressurizing unit include a combination of a heating roller and a pressurizing roller, and a combination of a heating roller, a pressurizing roller, and an endless belt. The heating temperature is not particularly limited, and may be appropriately selected according to the purpose. However, it is preferably from 80° C. to 200° C. If necessary, a publicly-known optical fixing device may be used in combination with the fixing unit.

<Cleaning Step and Cleaning Unit>

The cleaning step is a step of removing the toner remaining on the image bearing member, and can be performed by the cleaning unit preferably.

The cleaning blade of the present invention is used as the cleaning unit. The elastic member of the cleaning blade is not particularly limited, and an arbitrary elastic member may be selected according to the purpose. However, it is preferable that the elastic member abut on the surface of the image bearing member with a pressing force of from 10 N/m to 100 N/m. When the pressing force is less than 10 N/m, the toner may slip through the abutment region at which the elastic member of the cleaning blade abuts on the surface of the image bearing member, which makes it likely for a cleaning failure to occur. When the pressing force is greater than 100 N/m, a large friction force occurs at the abutment region, which may cause the cleaning blade to ride up. The pressing force is preferably from 10 N/m to 50 N/m.

The pressing force can be measured with, for example, a measuring instrument embedded with a small compact load cell manufactured by Kyowa Electronic Instruments Co., Ltd.

An angle formed between a tangent line at a point at which the elastic member of the cleaning blade abuts on the surface of the image bearing member and the end surface of the cleaning blade is not particularly limited, and may be appropriately selected according to the purpose. However, it is preferably from 65° to 85°.

When the angle θ is less than 65°, the cleaning blade may ride up. When it is greater than 85°, a cleaning failure may occur.

<Other Steps and Other Units>

Examples of the other units include a charge eliminating unit, a recycling unit, and a control unit.

Examples of the other steps include a charge eliminating step, a recycling step, and a control step.

—Charge Eliminating Step and Charge Eliminating Unit—

The charge eliminating step is a step of eliminating charges built up over the image bearing member by applying a charge eliminating bias thereto, and can be performed by the charge eliminating unit preferably.

The charge eliminating unit is not particularly limited, except that it should be able to apply a charge eliminating bias to the image bearing member, and an arbitrary charge eliminating unit may be selected from publicly-known charge eliminating units. Examples thereof include a charge eliminating lamp.

—Recycling Step and Recycling Unit—

The recycling step is a step of recycling a toner removed in the cleaning step to the developing unit, and can be performed by the recycling unit preferably.

The recycling unit is not particularly limited, and examples thereof include a publicly-known conveying unit.

—Control Step and Control Unit—

The control step is a step of controlling each step, and can be performed by the control unit preferably.

The control unit is not particularly limited, and an arbitrary control unit may be selected according to the purpose as long as it can control the operations of each unit. Examples thereof include devices such as a sequencer and a computer.

One example of an image forming apparatus of the present invention will be explained with reference to the drawings.

Figure 2:
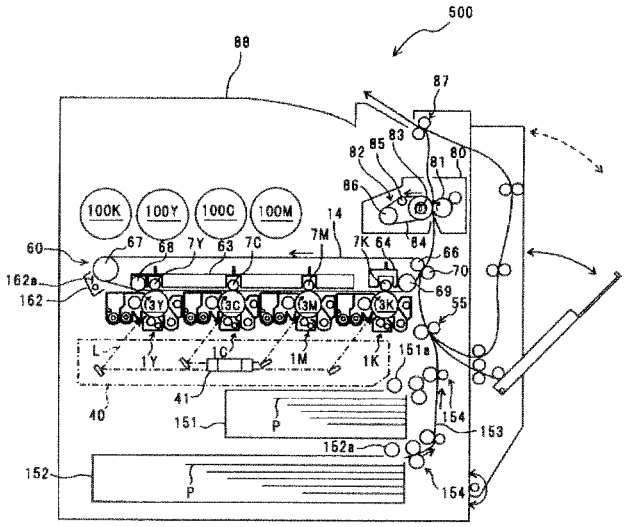
FIG. 2 is a schematic configuration diagram showing an example of an image forming apparatus of the present invention.

FIG. 2 is a schematic configuration diagram showing an example of an image forming apparatus 500 of the present invention. The image forming apparatus 500 includes four image forming units 1Y, 1C, 1M, and 1K for yellow, cyan, magenta, and black (hereinafter may be described as Y, C, M, and K). They use Y, C, M, and K toners having different colors from one another as image forming substances for forming images, but they are identical with one another in the other respects.

A transfer unit 60 including an intermediate transfer belt 14 as an intermediate transfer medium is disposed above the four image forming unit 1. Toner images of the respective colors formed on the surface of photoconductors 3Y, 3C, 3M, and 3K described later in detail, which are included in the image forming units 1Y, 1C, 1M, and 1K, are transferred onto the intermediate transfer belt 14 and overlaid together.

An optical writing unit 40 is disposed below the four image forming units 1. The optical writing unit 40, which is a latent image forming unit, irradiates the photoconductors 3Y, 3C, 3M, and 3K of the image forming units 1Y, 1C, 1M, and 1K with laser light L emitted based on image information. As a result, electrostatic latent images for Y, C, M, and K are formed over the photoconductors 3Y, 3C, 3M, and 3K. The optical writing unit 40 deflects the laser light L emitted from a light source by means of a polygon mirror 41 rotatably driven by a motor, so as for the photoconductors 3Y, 3C, 3M, and 3K to be irradiated with the laser light through a plurality of optical lenses and mirrors. Instead of this, it is also possible to employ a configuration for performing optical scanning with a LED array.

A first sheet feeding cassette 151 and a second sheet feeding cassette 152 are provided below the optical writing unit 40 in a vertically stacked state. A plurality of recording media P are contained in the form of a bundle of stacked sheets in each of the sheet feeding cassettes. A first sheet feeding roller 151*a* and a second sheet feeding roller 152*a* abut on the top recording media P, respectively. When the first sheet feeding roller 151*a* is rotatably driven counterclockwise in FIG. 2 by an unillustrated drive unit, the top recording medium P in the first sheet feeding cassette 151 is discharged toward a sheet feeding path 153 provided to extend vertically at a right-hand side, in FIG. 2, of the cassette. When the second sheet feeding roller 152*a* is rotatably driven counterclockwise in FIG. 2 by an unillustrated drive unit, the top recording medium P in the second sheet feeding cassette 152 is discharged toward the sheet feeding path 153.

A plurality of conveying roller pairs 154 are provided in the sheet feeding path 153. A recording medium P delivered to the sheet feeding path 153 is sandwiched between the rollers of these conveyer roller pairs 154, and conveyed from a lower side to an upper side in FIG. 2 in the sheet feeding path 153.

A registration roller pair 55 is provided at a conveying-direction-downstream end of the sheet feeding path 153. Upon sandwiching the recording medium P delivered from the conveying roller pairs 154 between the rollers, the registration roller pair 55 immediately stops the rotations of the rollers temporarily. Then, the registration roller pair brings forward the recording medium P toward a second transfer nip described later at an appropriate timing.

Figure 3:
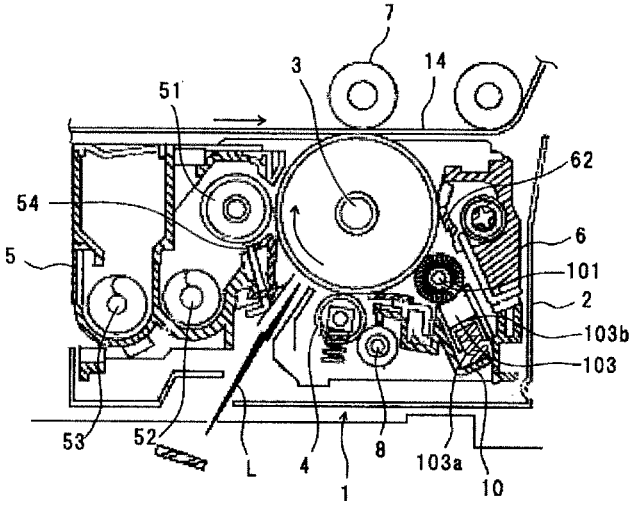
FIG. 3 is a schematic configuration diagram of an image forming unit of an example of an image forming apparatus of the present invention.

FIG. 3 is a configuration diagram showing a schematic configuration of one of the four image forming units 1.

As shown in FIG. 3, the image forming unit 1 includes a drum-shaped photoconductor 3 as an image bearing member. Although a drum-shaped photoconductor is shown, the photoconductor 3 may be sheet-shaped, or an endless belt-shaped.

A charging roller 4, a developing device 5, a first transfer roller 7, a cleaning device 6, a lubricant applying device 10, an unillustrated charge eliminating lamp, etc. are provided around the photoconductor 3. The charging roller 4 is a charging member included in a charging device as a charging unit. The developing device 5 is a developing unit configured to convert a latent image formed over the surface of the photoconductor 3 to a toner image. The first transfer roller 7 is a first transfer member included in a first transfer device as a first transfer unit configured to transfer the toner image over the surface of the photoconductor 3 onto the intermediate transfer belt 14. The cleaning device 6 is a cleaning unit configured to clean away a toner remaining over the photoconductor 3 after the toner image is transferred onto the intermediate transfer belt 14. The lubricant applying device 10 is a lubricant applying unit configured to apply a lubricant over the surface of the photoconductor 3 after cleaned by the cleaning device 6. The unillustrated charge eliminating lamp is a charge eliminating unit configured to eliminate a surface potential of the photoconductor 3 after cleaned.

The charging roller 4 is provided at a predetermined distance from the photoconductor 3 contactlessly, and electrically charges the photoconductor 3 to a predetermined polarity and to a predetermined potential. The surface of the photoconductor 3 uniformly charged by the charging roller 4 is irradiated with the laser light L based on image information by the optical writing unit 40 as the latent image forming unit, and an electrostatic latent image is formed thereon.

The developing device 5 includes a developing roller 51 as a developer bearing member. A developing bias is applied to the developing roller 51 from an unillustrated power supply. In the casing of the developing device 5, there are provided a feeding screw 52 and a stirring screw 53 configured to stir the developer contained in the casing by conveying the developer in opposite directions from each other. There is also provided a doctor 54 configured to regulate the developer borne over the developing roller 51. The toner in the developer stirred and conveyed by the two screws, namely the feeding screw 52 and the stirring screw 53 gets electrically charged to a predetermined polarity. Then, the developer is uplifted onto the surface of the developing roller 51. The uplifted developer is regulated by the doctor 54, and the toner gets deposited on the latent image over the photoconductor 3 in a developing region facing the photoconductor 3.

The cleaning device 6 includes a fur brush 101, a cleaning blade 62, etc. The cleaning blade 62 abuts on the photoconductor 3 in a direction counter to the surface motion direction of the photoconductor 3. The details of the cleaning blade 62 will be described later.

The lubricant applying device 10 includes a solid lubricant 103, a lubricant pressurizing spring 103*a*, etc., and uses a fur brush 101 as an applying brush for applying the solid lubricant 103 over the photoconductor 3. The solid lubricant 103 is retained on a bracket 103*b*, and pressurized by the lubricant pressurizing spring 103*a* toward the fur brush 101. Then, the solid lubricant 103 is scraped by the fur brush 101 rotating in a direction to follow up the rotation direction of the photoconductor 3, whereby the lubricant is applied over the photoconductor 3. The application of the lubricant over the photoconductor maintains the friction coefficient over the surface of the photoconductor 3 to 0.2 or lower during any time other than an image forming operation.

The charging device is a contactless proximal setting type, i.e., the charging roller 4 is provided in proximity of the photoconductor 3. The charging device may have a publicly-known configuration such as a corotron, a scorotron, and a solid charger (solid state charger). Among these charging systems, particularly a contact charging system or a contactless proximal setting system is more preferable, with advantages that a charging efficiency is high, ozone emission is low, downsizing of the apparatus is available, etc.

As the light source of the laser light L of the optical writing unit 40 and the light source of the charge eliminating lamp, etc., it is possible to use all kinds of light emitting products such as a fluorescent lamp, a tungsten lamp, a halogen lamp, a mercury lamp, a sodium-vapor lamp, a light emitting diode (LED), a laser diode (LD), and electroluminescence (EL).

It is also possible to use various kinds of filters such as a sharp cut filter, a band pass filter, a near infrared cut filter, a dichroic filter, an interference filter, and a color temperature conversion filter in order to irradiate the target only with light in a desired wavelength range.

Among these light sources, it is preferable to use a light emitting diode and a laser diode, because they have a high irradiation energy, and a long wavelength of from 600 nm to 800 nm.

The transfer unit 60 as a transfer unit shown in FIG. 2 includes a belt cleaning unit 162, a first bracket 63, a second bracket 64, etc. in addition to the intermediate transfer belt 14. It also includes four first transfer rollers 7Y, 7C, 7M, and 7K, a second transfer backup roller 66, a drive roller 67, an auxiliary roller 68, a tension roller 69, etc. While being tensed by these eight roller members, the intermediate transfer belt 14 is endlessly moved counterclockwise in FIG. 2 by being rotatably driven by the drive roller 67. The four first transfer rollers 7Y, 7C, 7M, and 7K form first transfer nips respectively, with the intermediate transfer belt 14 moved endlessly in this way sandwiched between themselves and the photoconductors 3Y, 3C, 3M, and 3K. A transfer bias having an opposite polarity (e.g., plus) to that of the toner is applied to the back side (an internal circumferential surface of the loop) of the intermediate transfer belt 14. The Y, C, M, and K toner images over the photoconductors 3Y, 3C, 3M, and 3K are firstly transferred onto the external side of the intermediate transfer belt 14 in an overlaid state while the intermediate transfer belt is sequentially passing through the first transfer nips for Y, C, M, and K along with the endless motion thereof. As a result, a four-color overlaid toner image (hereinafter may be referred to as a four-color toner image) is formed.

The second transfer backup roller 66 forms a second transfer nip, with the intermediate transfer belt 14 sandwiched between itself and a second transfer roller 70 provided outside the loop of the intermediate transfer belt 14. The registration roller pair 55 described before brings forward the recording medium P sandwiched between the rollers toward the second transfer nip, at a timing at which the recording medium can synchronize with the four-color toner image over the intermediate transfer belt 14. The four-color toner image over the intermediate transfer belt 14 is secondly transferred onto the recording medium P all at once in the second transfer nip, because of the effects of a second transfer electric field formed between the second transfer roller 70 to which a second transfer bias is applied and the second transfer backup roller 66, and a nip pressure. Then, combined with the white color of the recording medium P, the four-color toner image becomes a full-color toner image.

The intermediate transfer belt 14 having passed through the second transfer nip has a transfer residue toner that remains thereon without having been transferred onto the recording medium P. The residue toner is cleaned by the belt cleaning unit 162. A belt cleaning blade 162*a* of the belt cleaning unit 162 abuts on the external side of the intermediate transfer belt 14, and thereby scrapes off and removes the transfer residue toner over the intermediate transfer belt 14.

The first bracket 63 of the transfer unit 60 is configured to swing about a rotation axis of the auxiliary roller 68 by a predetermined rotation angle, when an unillustrated solenoid is driven on/off. In formation of a monochrome image, the image forming apparatus 500 makes the first bracket 63 rotate slightly counterclockwise in FIG. 2, by driving the solenoid described above. With this rotation, it causes the first transfer rollers 7Y, 7C, and 7M for Y, C, and M to commonly rotate about the rotation axis of the auxiliary roller 68 counterclockwise in FIG. 2, to thereby cause the intermediate transfer belt 14 to be detached from the photoconductors 3Y, 3C, and 3M for Y, C, and M. Then, it drives only the image forming unit 1K for K among the four image forming units 1Y, 1C, 1M, and 1K, to thereby form a monochrome image. Therefore, it can prevent the members constituting the image forming units 1 for Y, C, and M from being fatigued, by saving wasteful driving of these image forming units 1 during formation of a monochrome image.

A fixing unit 80 is provided above the second transfer nip in FIG. 2. The fixing unit 80 includes a pressurizing/heating roller 81 enclosing a heat generation source such as a halogen lamp, and a fixing belt unit 82. The fixing belt unit 82 includes a fixing belt 84 which is a fixing member, a heating roller 83 enclosing a heat generation source such as a halogen lamp, a tension roller 85, a drive roller 86, an unillustrated temperature sensor, etc. The fixing roller 84 having an endless shape is endlessly moved counterclockwise in FIG. 2, while being tensed by the heating roller 83, the tension roller 85, and the drive roller 86. In the process of this endless moving, the back side of the fixing belt 84 is heated by the heating roller 83. The fixing belt 84 heated in this way by being hung over the heating roller 83 has the external side of the hung portion thereof abutted by the pressurizing/heating roller 81 that is rotatably driven clockwise in FIG. 2. Hence, there is formed a fixing nip at which the pressurizing/heating roller 81 and the fixing belt 82 abut on each other.

The unillustrated temperature sensor is provided outside the loop of the fixing belt 84, such that it faces the external side of the fixing belt 84 with a predetermined gap between them. It senses the surface temperature of the fixing belt 84 immediately before the belt comes into the fixing nip. The sensing result is transmitted to an unillustrated fixing power supply circuit. Based on the sensing result of the temperature sensor, the fixing power supply circuit controls whether to turn on or off the power supply to the heat generation source enclosed in the heating roller 83 and to the heat generation source enclosed in the pressurizing/heating roller 81.

The recording medium P having passed through the second transfer nip described above is delivered into the fixing unit 80 after it departs from the intermediate transfer belt 14. Then, the recording medium is conveyed from a lower side to an upper side in FIG. 2 while being sandwiched in the fixing nip in the fixing unit 80. During this process, it is heated and pressed by the fixing belt 84. As a result, the full-color toner image is fixed on the recording medium P.

The recording medium P that has undergone the fixing process passes between rollers of a sheet discharging roller pair 87 and then is discharged outside the apparatus. There is a stack region 88 on the top of the apparatus housing of the image forming apparatus 500. The recording medium P discharged outside the apparatus by the sheet discharging roller pair 87 is stacked over the stack region 88 in order.

There are four toner cartridges 100Y, 100C, 100M, and 100K containing Y, C, M, and K toners above the transfer unit 60. The Y, C, M, and K toners in the toner cartridges 100Y, 100C, 100M, and 100K are supplied into developing devices 5Y, 5C, 5M, and 5K in the image forming units 1Y, 1C, 1M, and 1K, where necessary. The toner cartridges 100Y, 100C, 100M, and 100K are attachable on and detachable from the image forming apparatus body independently from the image forming units 1M, 1C, 1M, and 1K.

Next, an image forming operation of the image forming apparatus 500 will be explained.

When the image forming apparatus receives a print execution signal from an unillustrated operation unit or the like, predetermined voltages or currents are applied to the charging roller 4 and the developing roller 51 sequentially at predetermined timings. Likewise, predetermined voltages or currents are applied to the light sources of the optical writing unit 40, the charge eliminating lamp, etc. sequentially at predetermined timings. Synchronously, the photoconductor 3 is rotatably driven in the direction of the arrow in FIG. 2 by a photoconductor drive motor (unillustrated) which is a drive unit.

With the rotation of the photoconductor 3 in the direction of the arrow in FIG. 2, the surface of the photoconductor 3 is electrically charged uniformly to a predetermined potential by the charging roller 4. The photoconductor 3 is irradiated with laser light L from the optical writing unit 40 corresponding to image information. Charges are eliminated from the portion of the surface of the photoconductor 3 irradiated with the laser light L, and an electrostatic latent image is formed on the portion.

The surface of the photoconductor 3 over which the electrostatic latent image is formed is frictioned by a magnetic brush of the developer formed over the developing roller 51, at a region facing the developing device 5. The negatively charged toner on the developing roller 51 is moved to the electrostatic latent image due to a predetermined developing bias applied to the developing roller 51. As a result, the electrostatic latent image turns to a toner image (i.e., is developed). The same image forming process is performed in the respective image forming units 1, and toner images of respective colors are formed over the surface of the photoconductors 3Y, 3C, 3M, and 3K of the respective image forming units 1Y, 1C, 1M, and 1K.

In the image forming apparatus 500, the electrostatic latent image formed over the photoconductor 3 is reversely developed by the developing device 5 with the toner charged to the negative polarity, as described above. In the present embodiment, a case of using a contactless charging roller system of a N/P type (negative/positive; a toner is deposited on a low-potential position) has been explained. However, the present invention is not limited to this case.

The toner images of the respective colors formed over the surface of the photoconductors 3Y, 3C, 3M, and 3K are firstly transferred sequentially such that they are overlaid together over the surface of the intermediate transfer belt 14. As a result, a four-color toner image is formed over the intermediate transfer belt 14.

The four-color toner image formed over the intermediate transfer belt 14 is transferred onto a recording medium P that is fed to the second transfer nip from the first sheet feeding cassette 151 or the second sheet feeding cassette 152 via between the rollers of the registration roller pair 55. The recording medium P is fed to the second transfer nip after once it stops in the state of being sandwiched by the registration roller pair 55 to become synchronous with the leading end of the image over the intermediate transfer belt 14. The recording medium P onto which the toner image has been transferred is detached from the intermediate transfer belt 14 and conveyed to the fixing unit 80. By passing through the fixing unit 80, the recording medium P onto which the toner image has been transferred has the toner image fixed on the recording medium P by the effects of heat and pressure. The recording medium P on which the toner image is fixed is discharged outside the image forming apparatus 500, and stacked over the stack region 88.

Meanwhile, any transfer residue toner over the surface of intermediate transfer belt 14 that has transferred the toner image onto the recording medium P at the second transfer nip is removed by the belt cleaning unit 162.

Further, any transfer residue toner over the surface of the photoconductor 3 that has transferred the toner image of the respective color onto the intermediate transfer belt 14 at the first transfer nip is removed by the cleaning device 6. Then, the lubricant is applied over the surface by the lubricant applying device 10, and charges are removed from the surface by the charge eliminating lamp.

As the image forming unit 1 of the image forming apparatus 500, the photoconductor 3, and as process units, the charging roller 4, the developing device 5, the cleaning device 6, the lubricant applying device 10, etc. are enclosed within a frame 2 as shown in FIG. 3. The image forming unit 1 is attachable to and detachable from the body of the image forming apparatus 500 as one integrated unit as a process cartridge. The image forming apparatus 500 is configured such that the photoconductor 3 and the process units are replaced with new ones simultaneously as one integrated unit as a process cartridge. However, it may also be configured such that the photoconductor 3, the charging roller 4, the developing device 5, the cleaning device 6, the lubricant applying device 10, etc. are replaced with new ones as separate units.

In terms of improving the image quality, it is preferable that the toner used in the image forming apparatus 500 be a polymerization toner produced according to a suspension polymerization method, an emulsion polymerization method, or a dispersion polymerization method with which it is easy to obtain a high circularity and a small particle diameter. Among such toners, a polymerization toner having an average circularity of 0.97 or greater and a volume average particle diameter of 5.5 μm or less is preferable, in terms of forming a high-resolution image.

Figure 1B:
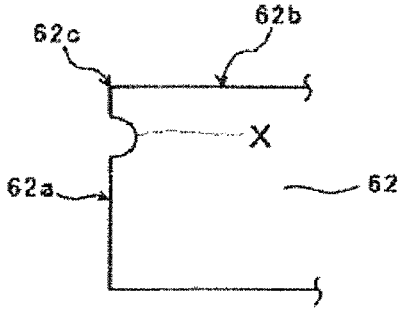
PRIOR ART FIG. 1B
FIG. 1B is a diagram explaining a local wear at a leading end surface of a conventional cleaning blade.
Figure 1C:
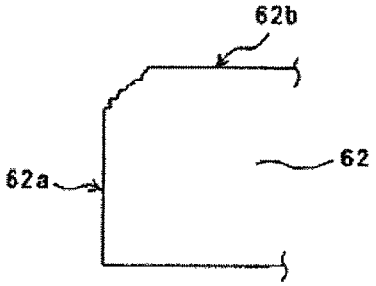
PRIOR ART FIG. 1C
FIG. 1C is a diagram showing a state of an abutment part of a conventional cleaning blade having been dropped off.

A polymerization toner having a high circularity and a small particle diameter cannot be sufficiently removed from the surface of the photoconductor 3 when the cleaning blade 62 tries to remove it in the same manner as when removing a conventional pulverization toner from the surface of the photoconductor 3, which results in a cleaning failure. However, if the abutting pressure of the cleaning blade 62 against the photoconductor 3 is increased in order for the cleaning performance to be improved, there occurs a problem that the cleaning bade 62 may be worn soon. Furthermore, the cleaning blade 62 is frictioned with the photoconductor 3 with a greater frictional force, which causes the abutment part (leading end edge portion) 62*c* of the cleaning blade 62 abutting on the photoconductor 3 to be dragged in the moving direction of the photoconductor 3 and ride up (see FIG. 1A to FIG. 1C). If the abutment part 62*c* of the cleaning blade 62 rides up, there occur various problems such as abnormal noise, vibrations, and drop off of the abutment part.

Figure 4:
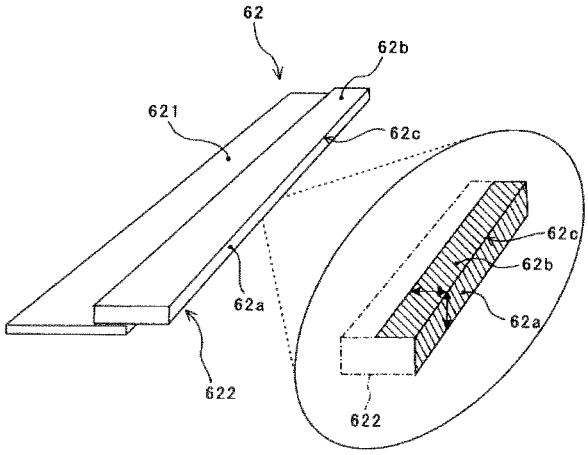
FIG. 4 is a perspective diagram showing an example of a cleaning blade of the present invention.
Figure 5A:
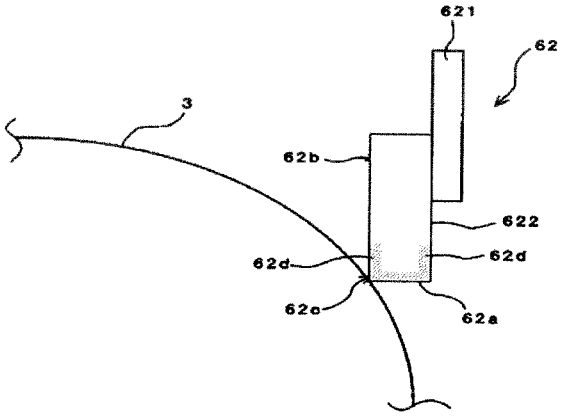
FIG. 5A is an enlarged cross-sectional diagram showing a state of a cleaning blade abutting on a surface of an image bearing member.
Figure 5B:
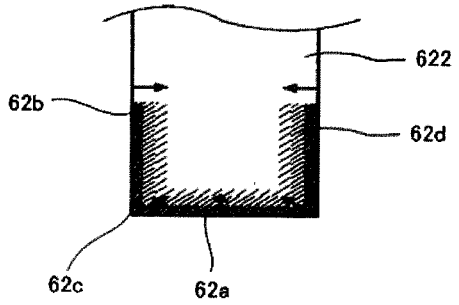
FIG. 5B is an enlarged diagram of a vicinity of an abutment part of a cleaning blade.

FIG. 4 is a perspective diagram of the cleaning blade 62. FIG. 5A and FIG. 5B are enlarged cross-sectional diagrams of the cleaning blade 62. FIG. 5A is an diagram explaining a state of the cleaning blade 62 abutting on the surface of the photoconductor 3. FIG. 5B is an enlarged diagram explaining the vicinity of the abutment part (leading end edge portion) 62*c* of the cleaning blade 62.

As shown in FIG. 4, the cleaning blade 62 is constituted by a flat-plate-shaped support member 621 made of a stiff material such as a metal and hard plastic, and a flat-plate-shaped elastic member 622. The elastic member 622 is bonded to one end of the support member 621 with an adhesive or the like. The other end of the support member 621 is supported on the case of the cleaning device 6 as a cantilever.

As shown in FIG. 5A, the cleaning blade 62 is constituted by the support member 621, and the flat-plate-shaped elastic member 622 of which one end is joined to the support member, and of which other end is a free end having a predetermined length. The cleaning blade is positioned such that the abutment part 62*c* of the elastic member 622, which is one of ends of the elastic member at the free end side, abuts on the surface of the image bearing member 3 along a longer direction of the image bearing member.

It is preferable that the elastic member 622 have a high modulus of repulsion elasticity, in order to be able to follow or conform to decentering of the image bearing member 3 or minute undulations over the surface of the image bearing member 3. A polyurethane rubber or the like is preferable as the elastic member. A JIS-A hardness of the elastic member is preferably 60 degrees or greater. The modulus of repulsion elasticity of the elastic member according to JIS K6255 standard is preferably 35% or lower at 23° C.

The abutment part 62*c* of the elastic member 622 to abut on the surface of the image bearing member contains a cured product of an ultraviolet-curable composition that contains a (meth)acrylate compound having an alicyclic structure having 6 or more carbon atoms in the molecule thereof (the (meth)acrylate compound being particularly preferably a (meth)acrylate compound having a tricyclodecane structure, or a (meth)acrylate compound having an adamantane structure).

When the ultraviolet-curable composition containing a (meth)acrylate compound having an alicyclic structure having 6 or more carbon atoms in the molecule thereof is impregnated into the abutment part of the elastic member and irradiated with ultraviolet, an impregnated portion 62*d* shown in FIG. 5B is formed. The impregnated portion can enhance the hardness of the abutment part 62*c*, improve the durability, and suppress the elastic member from being deformed in the surface motion direction of the image bearing member 3. Furthermore, the impregnated portion 62*d* can likewise suppress deformation of the elastic member also when an internal portion of the elastic member is exposed due to a wear of the surface layer over time.

(Process Cartridge)

The process cartridge of the present invention includes at least an image bearing member, and a cleaning unit configured to remove a toner remaining over the image bearing member, and further includes other members according to necessity.

The cleaning blade of the present invention is used as the cleaning unit.

The process cartridge is a device (part) that includes inside an image bearing member and the cleaning blade of the present invention, further includes at least one selected from a charging unit, an exposing unit, a developing unit, a transfer unit, a cleaning unit, and a charge eliminating unit, and is attachable to and detachable from an image bearing member.

EXAMPLES

Examples of the present invention will be explained below. The present invention is not limited to these Examples by any means.

<JIS-A Hardness of Elastic Member>

A JIS-A hardness of an elastic member was measured with a microrubber hardness tester MD-1 manufactured by Kobunshi Keiki Co., Ltd. according to JIS K6253. Note that an elastic member having a two-layered structure was measured from both sides.

<Modulus of Repulsion Elasticity>

A modulus of repulsion elasticity of an elastic member was measured with RESILIENCE TESTER NO. 221 manufactured by Toyo Seiki Seisaku-Sho, Ltd. according to JIS K6255. A measurement sample was a product obtained by pasting sheets each having a thickness of about 2 mm with each other to achieve a total thickness of about 4 mm.

<Martens Hardness of Surface of Reformed Layer and of Region Inward from Surface of Reformed Layer Thicknesswise>

A Martens hardness of a surface of a reformed layer, and of a region inward from the surface of the reformed layer thicknesswise was measured with a microhardness tester HM-2000 manufactured by Fischer Instruments K.K. A measurement sample was a product cut out from about the reformed layer. The surface of the reformed layer was measured at a point on the lower surface 62*b* that was 20 μm away from the abutment part 62*c*. The region inward from the surface of the reformed layer thicknesswise was measured in the impregnated portion 62*d* sequentially inward from the surface of the reformed layer thicknesswise until a Martens hardness and a modulus of repulsion elasticity became equal to those of the elastic member. An indenter used was a Vickers indenter.

<Average Circularity of Toner>

Figure 6A:
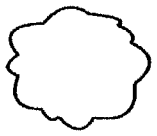
FIG. 6A is an explanatory diagram explaining a method for measuring an average circularity of a toner.
Figure 6B:
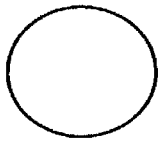
FIG. 6B is an explanatory diagram explaining a method for measuring an average circularity of a toner.

An average circularity of a toner was measured with a flow-type particle image analyzer (FPIA-2000 manufactured by Sysmex Corporation). A specific manner was as follows. A surfactant (an alkylbenzene sulfonate salt) (from 0.1 mL to 0.5 mL) as a dispersant was added to water from which impurity solids were removed in advance (from 100 mL to 150 mL) in a vessel, and a measurement sample (a toner) (from about 0.1 g to 0.5 g) was further added thereto. After this, the resulting suspension liquid in which the toner was dispersed was subjected to a dispersion treatment with an ultrasonic disperser for from 1 minute to 3 minutes, until the concentration of the dispersion liquid became from 3,000 particles/μL to 10,000 particles/μL. The obtained dispersion liquid was set on the analyzer described above, and the shape and distribution of the toner were measured. Based on the measurement result, a perimeter C1 and a projected area S of an actual projected shape of a toner particle shown in FIG. 6A were obtained. Then, a value C2/C1 was calculated, where C2 was a perimeter of a true circle shown in FIG. 6B having the same area as the projected area S. An average of such C2/C1 values was obtained as an average circularity.

<Volume Average Particle Diameter of Toner>

A volume average particle diameter of a toner was obtained according to a Coulter counter method. A specific manner was as follows. Data on a number distribution and a volume distribution of a toner measured with COULTER MULTISIZER TYPE 2E (manufactured by Beckman Coulter Inc.) was transmitted to a personal computer via an interface (manufactured by Nikkaki Bios Co., Ltd.). More specifically, a 1% by mass NaCl aqueous solution using primary sodium chloride was prepared as an electrolysis solution. A surfactant (an alkylbenzene sulfonate salt) (from 0.1 mL to 5 mL) as a dispersant was added to this electrolytic aqueous solution (from 100 mL to 150 mL). A toner (from 2 mg to 20 mg) as a measurement sample was further added thereto, and the resultant was subjected to a dispersion treatment with an ultrasonic disperser for from 1 minute to 3 minutes. Then, the electrolytic aqueous solution (from 100 mL to 200 mL) was poured into another beaker, into which the solution after the dispersion treatment was added up to a predetermined concentration. The resultant was processed with COULTER MULTISIZER TYPE 2E described above.

With a 100 μm aperture, particle diameters of 50,000 toner particles were measured. Channels used were 13 channels, namely channels of 2.00 μm or greater but less than 2.52 μm; 2.52 μm or greater but less than 3.17 μm; 3.17 μm or greater but less than 4.00 μm; 4.00 μm or greater but less than 5.04 μm; 5.04 μm or greater but less than 6.35 μm; 6.35 μm or greater but less than 8.00 μm; 8.00 μm or greater but less than 10.08 μm; 10.08 μm or greater but less than 12.70 μm; 12.70 μm or greater but less than 16.00 μm; 16.00 μm or greater but less than 20.20 μm; 20.20 μm or greater but less than 25.40 μm; 25.40 μm or greater but less than 32.00 μm; and 32.00 μm or greater but less than 40.30 μm. Target toner particles were those having a particle diameter of from 2.00 μm to 32.0 μm.

Then, a volume average particle diameter was calculated according to a relational formula "volume average particle diameter=ΣXfV/ΣfV", where "X" was a representative diameter in each channel, "V" was an equivalent volume of the representative diameter in each channel, and "f" was a number of particles in each channel.

Production Example 1

—Production of Elastic Member 1—

A flat-plate-shaped elastic member 1 having an average thickness of 1.8 mm and a size of 11.5 mm×32.6 mm was produced with reference to a method for producing a single-layered cleaning blade described as a referential example in JP-A No. 2011-141449.

The obtained elastic member 1 had a JIS-A hardness of 68 degrees and a modulus of repulsion elasticity of 30%.

Production Example 2

Production of Elastic Member 2—

A two-layered elastic member 2 having an average thickness of 1.8 mm and a size of 11.5 mm×32.6 mm was produced with reference to a method for producing a cleaning blade described in Example 1 in JP-A No. 2011-141449.

The obtained two-layered elastic member 2 had a JIS-A hardness of 80 degrees at an abutment surface side, a JIS-A hardness of 75 degrees at a side opposite from the abutment surface side, and a modulus of repulsion elasticity of 25%.

Preparation Example 1

—Preparation of Ultraviolet-Curable Composition 1—

An ultraviolet-curable composition 1 was prepared with the components below according to a common procedure.

| | |
|---|---|
| Tricyclodecane dimethanol diacrylate represented by the structural formula below (product name: A-DCP manufactured by Shin-Nakamura Chemical Co., Ltd., with 2 functional groups, and a molecular weight of 304) | 50 parts by mass |

-continued

| | |
|---|---|
| 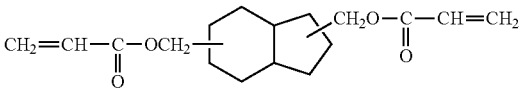 | |
| Polymerization initiator (IRGACURE 184 manufactured by Ciba Specialties Chemicals Corporation) | 5 parts by mass |
| Solvent (cyclohexanone) | 55 parts by mass |

Preparation Example 2

—Preparation of Ultraviolet-Curable Composition 2—

An ultraviolet-curable composition 2 was prepared with the components below according to a common procedure.

Tricyclodecane dimethanol diacrylate represented by the structural formula above (product name: A-DCP manufactured by Shin-Nakamura Chemical Co., Ltd., with 2 functional groups, and a molecular weight of 304) - - - 80 parts by mass Polymerization initiator (IRGACURE 184 manufactured by Ciba Specialties Chemicals Corporation) - - - 8 parts by mass Solvent (cyclohexanone) - - - 22 parts by mass Preparation Example 3

—Preparation of Ultraviolet-Curable Composition 3—

An ultraviolet-curable composition 3 was prepared with the components below according to a common procedure.

| | |
|---|---|
| Tricyclodecane dimethanol diacrylate represented by the structural formula above (product name: A-DCP manufactured by Shin-Nakamura Chemical Co., Ltd., with 2 functional groups, and a molecular weight of 304) | 20 parts by mass |
| Polymerization initiator (IRGACURE 184 manufactured by Ciba Specialties Chemicals Corporation) | 2 parts by mass |
| Solvent (cyclohexanone) | 88 parts by mass |

Preparation Example 4

—Preparation of Ultraviolet-Curable Composition 4—

An ultraviolet-curable composition 4 was prepared with the components below according to a common procedure.

| | |
|---|---|
| Tricyclodecane dimethanol diacrylate represented by the structural formula above (product name: A-DCP manufactured by Shin-Nakamura Chemical Co., Ltd., with 2 functional groups, and a molecular weight of 304) | 90 parts by mass |
| Polymerization initiator (IRGACURE 184 manufactured by Ciba Specialties Chemicals Corporation) | 9 parts by mass |
| Solvent (cyclohexanone) | 11 parts by mass |

Preparation Example 5

—Preparation of Ultraviolet-Curable Composition 5—

An ultraviolet-curable composition 5 was prepared with the components below according to a common procedure.

| | |
|---|---|
| A (meth)acrylate component 1 having an adamantane structure represented by the structural formula below (X-DA manufactured by Idemitsu Kosan Co., Ltd., with 2 functional groups, and a molecular weight of from 276 to 304, a reaction product between 1,3-adamantane diol and an acrylic acid) | 50 parts by mass |
| 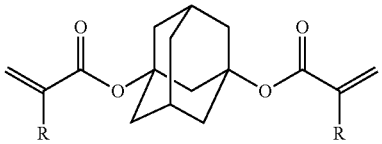 | |
| (R = H, $CH_3$) | |

In the formula, R represents a hydrogen atom or a methyl group.

| | |
|---|---|
| Polymerization initiator (IRGACURE 184 manufactured by Ciba Specialties Chemicals Corporation) | 5 parts by mass |
| Solvent (cyclohexanone) | 55 parts by mass |

Preparation Example 6

—Preparation of Ultraviolet-Curable Composition 6—

An ultraviolet-curable composition 6 was prepared with the components below according to a normal procedure.

| | |
|---|---|
| A (meth)acrylate component 2 having an adamantane structure represented by the structural formula below (1,3-adamantane dimethanol diacrylate, X-A-201 manufactured by Idemitsu Kosan Co., Ltd., with 2 functional groups, and a molecular weight of 304, a reaction product between 1, 3-adamantane diol and an acrylic acid) | 50 parts by mass |
| 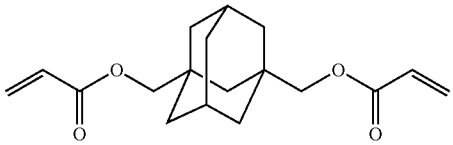 | |
| Polymerization initiator (IRGACURE 184 manufactured by Ciba Specialties Chemicals Corporation) | 5 parts by mass |
| Solvent (cyclohexanone) | 55 parts by mass |

Preparation Example 7

—Preparation of Ultraviolet-Curable Composition 7—

An ultraviolet-curable composition 7 was prepared with the components below according to a common procedure.

| | |
|---|---|
| A (meth)acrylate component 3 having an adamantane structure represented by the structural formula below (DIAPURESTE ADTM manufactured by Mitsubishi Gas Chemical Company, Inc., with 3 functional groups, and a molecular weight of 388) | 50 parts by mass |

-continued

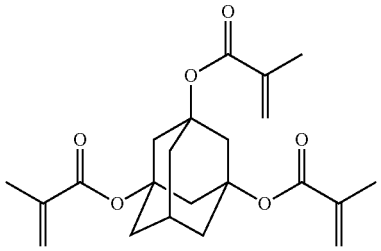

| | |
|---|---|
| Polymerization initiator (IRGACURE 184 manufactured by Ciba Specialties Chemicals Corporation) | 5 parts by mass |
| Solvent (cyclohexanone) | 55 parts by mass |

Preparation Example 8

—Preparation of Ultraviolet-Curable Composition 8—

An ultraviolet-curable composition 8 was manufactured with the components below according to a common procedure.

| | |
|---|---|
| Tricyclodecane dimethanol diacrylate represented by the structural formula above (A-DCP manufactured by Shin-Nakamura Chemical Co., Ltd., with 2 functional groups, and a molecular weight of 304) | 25 parts by mass |
| Pentaerythritol triacrylate represented by the structural formula below (PETIA manufactured by Daicel-Cytec Co., Ltd., with 3 functional groups, and a molecular weight of 298) | 25 parts by mass |

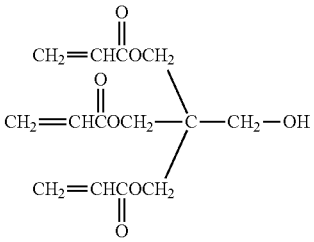

| | |
|---|---|
| Polymerization initiator (IRGACURE 184 manufactured by Ciba Specialties Chemicals Corporation) | 5 parts by mass |
| Solvent (cyclohexanone) | 55 parts by mass |

Preparation Example 9

—Preparation of Ultraviolet-Curable Composition 9—

An ultraviolet-curable composition 9 was prepared with the components below according to a common procedure.

| | |
|---|---|
| A (meth)acrylate component 2 having an adamantane structure represented by the structural formula above (1,3-adamantane dimethanol diacrylate, X-A-201 manufactured by Idemitsu Kosan Co., Ltd., with 2 functional groups, and a molecular weight of 304) | 25 parts by mass |
| Pentaerythritol triacrylate represented by the structural formula above (PETIA manufactured by Daicel-Cytec Co., Ltd., with 3 functional groups, and a molecular weight of 298) | 25 parts by mass |

-continued

| | |
|---|---|
| Polymerization initiator (IRGACURE 184 manufactured by Ciba Specialties Chemicals Corporation) | 5 parts by mass |
| Solvent (cyclohexanone) | 55 parts by mass |

Preparation Example 10

—Preparation of Ultraviolet-Curable Composition 10—

An ultraviolet-curable composition 10 was prepared with the components below according to a common procedure.

| | |
|---|---|
| Pentaerythritol triacrylate represented by the structural formula above (PETIA manufactured by Daicel-Cytec Co., Ltd., with 3 functional groups, and a molecular weight of 298) | 50 parts by mass |
| Polymerization initiator (IRGACURE 184 manufactured by Ciba Specialties Chemicals Corporation) | 5 parts by mass |
| Solvent (cyclohexanone) | 55 parts by mass |

Preparation Example 11

—Preparation of Ultraviolet-Curable Composition 11—

An ultraviolet-curable composition 11 was prepared with the components below according to a common procedure.

| | |
|---|---|
| Dipentaerythritol hexaacrylate represented by the structural formula below (DPHA manufactured by Daicel-Cytec Co., Ltd., with 6 functional groups, and a molecular weight of 578) | 59 parts by mass |

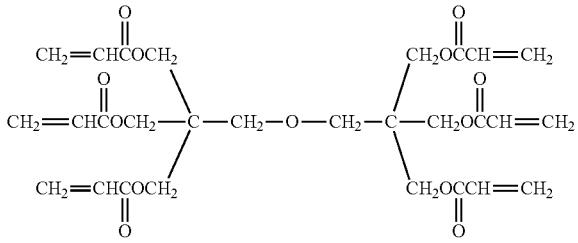

| | |
|---|---|
| Polymerization initiator (IRGACURE 184 manufactured by Ciba Specialties Chemicals Corporation) | 5 parts by mass |
| Solvent (cyclohexanone) | 55 parts by mass |

Toner Production Example

Toner base particles having an average circularity of 0.98 and a volume average particle diameter of 4.9 μm were produced according to a polymerization method. Silica particles having a small particle diameter (H2000 manufactured by Clariant K.K.) (1.5 parts by mass), titanium oxide particles having a small particle diameter (MT-150AI manufactured by Tayca Corporation) (0.5 parts by mass), and silica particles having a large particle diameter (UFP-30H manufactured by Denki Kagaku Kogyo Kabushiki Kaisha) were mixed and stirred with the obtained toner base particles (100 parts by mass) with a Henechel mixer, to thereby produce a toner.

<Production of Cleaning Blade 1>

A portion of the elastic member 1 that was by 2 mm from one end of the elastic member that was to abut on an image bearing member was immersed for 2 hours in a liquid obtained by diluting the ultraviolet-curable composition 1 with a diluent (cyclohexanone) to a solid content concentration of 50% by mass, and then air-dried for 3 minutes. After air-dried, the elastic member was irradiated with ultraviolet (140 W/cm×5 m/min×5 passes), with an ultraviolet irradiation equipment (UVC-2534/1MNLC3 manufactured by Ushio Inc.). Next, with a thermal dryer, the elastic member was dried at a dryer internal temperature of 100° C. for 15 minutes. In this way, a reformed layer was formed over the abutment part of the elastic member.

Next, the elastic member 1 after the surface curing treatment was fixed on a sheet metal holder which was a support member, with an adhesive, to thereby produce a cleaning blade 1.

Next, the produced cleaning blade 1 was mounted in a color multifunction peripheral (IMAGIO MP C5001 manufactured by Ricoh Company Ltd.), at a predetermined edge biting amount (linear pressure) and a predetermined mounting angle. The linear pressure and the mounting angle were varied depending on the type of the cleaning blade samples.

The toner was set in the above color multifunction peripheral (IMAGIO MP C5001 manufactured by Ricoh Company Ltd.), and a chart having an image occupation rate of 5% was output on 10,000 sheets (A4 size, horizontally long) at 3 prints/job under conditions of 21° C. and 65% RH. After this, an amount of riding up of the abutment part, cleaning performance, and an amount of wear of the abutment part were evaluated in the manner described below. The results are shown in Table 3.

<Amount of Riding Up of Abutment Part>

The cleaning blade was frictionally slid over a glass plate to which a material used as a surface layer of a photoconductor was applied, at the predetermined edge biting amount (linear pressure) and the predetermined mounting angle described above. The abutting condition of the cleaning blade was observed from the back side of the glass plate, and an image thereof was output with a CCD camera (NIKON CM-5 manufactured by Nikon Corporation). From the image, the length of the riding up of the abutment part of the elastic member of the cleaning blade was measured.

<Cleaning Performance>

After the outputting on 10,000 sheets was completed, a chart representing a pattern of three 43 mm-width longitudinal bands (longitudinal in the sheet passing direction) was output as an evaluation image on 20 sheets (A4 size, horizontally long). Then, an output image after this was observed visually, and cleaning performance was evaluated based on the criteria below. Note that an abnormal image means a streak or band-shaped image or a white spot image that appeared in a printed image.

[Evaluation Criteria]

A: There was no abnormal image.

B: There was an abnormal image.

<Amount of Wear of Abutment Part>

Figure 7:
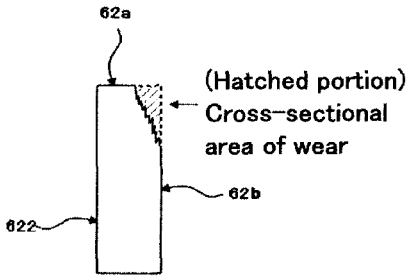
FIG. 7 is a diagram showing a method for measuring an amount of wear of a cleaning blade in Examples.

After the outputting on 10,000 sheets was completed, an amount of wear of the abutment part of the elastic member was measured with a laser microscope VK-9510 manufactured by Keyence Corporation, as a width of wear measured from the leading end surface of the elastic member as shown in FIG. 7.

Examples 2 to 9 and Comparative Examples 1 to 3

—Production of Cleaning Blades 2 to 9 and 14 to 16—

Cleaning blades 2 to 9 and 14 to 16 of Examples 2 to 9 and Comparative Examples 1 to 3 were produced in the same manner as in Example 1, except that unlike in Example 1, the ultraviolet-curable composition was changed to those shown in Table 2. Note that the cleaning blade obtained in Comparative Example 1 had no reformed layer.

An amount of riding up of the abutment part, cleaning performance, and an amount of wear of the abutment part of each obtained cleaning blade were evaluated in the same manner as in Example 1. The results are shown in Table 3.

Examples 10 to 11 and Comparative Example 4

—Production of Cleaning Blades 10 to 11 and 17—

Cleaning blades 10 to 11 and 17 of Examples 10 to 11 and Comparative Example 4 were produced in the same manner as in Example 1, except that unlike in Example 1, the ultraviolet-curable composition was changed to those shown in Table 2, and the impregnation time was changed to 6 hours.

An amount of riding up of the abutment part, cleaning performance, and an amount of wear of the abutment part of each obtained cleaning blade were evaluated in the same manner as in Example 1. The results are shown in Table 3.

Examples 12 to 13

—Production of Cleaning Blades 12 to 13—

Cleaning blades 12 to 13 of Examples 12 to 13 were produced in the same manner as in Example 1, except that unlike in Example 1, the elastic member 2 shown in Table 1 and the ultraviolet-curable compositions shown in Table 2 were used instead. Note that a two-layered elastic member was a product obtained by pasting two different kinds of rubbers having different physical properties with each other, as described above. A portion of the elastic member that is to contact an image bearing member (i.e., the abutment part, or the leading end edge portion) was made of the rubber having the greater hardness.

An amount of riding up of the abutment part, cleaning performance, and an amount of wear of the abutment part of each obtained cleaning blade were evaluated in the same manner as in Example 1. The results are shown in Table 3.

In Table 1, "No." represents the elastic member 1 or 2 described above. In Table 2, "No." represents the ultraviolet-curable compositions 1 to 11 described above.

In Table 3, "amount of wear" that was "unmeasurable" means that the amount of wear could not be measured because it was too large, and "H/L" that was "unmeasurable" means that H/L could not be measured because there was no reformed layer.

TABLE 1

| | | Elastic member | | | | |
|---|---|---|---|---|---|---|
| | Cleaning blade No. | No. | Structure | JIS-A hardness | Modulus of repulsion elasticity | Elastic power |
| Ex. 1 | Cleaning blade 1 | 1 | Single layered | 68 degrees | 30% | 89% |
| Ex. 2 | Cleaning blade 2 | 1 | Single layered | 68 degrees | 30% | 89% |
| Ex. 3 | Cleaning blade 3 | 1 | Single layered | 68 degrees | 30% | 89% |
| Ex. 4 | Cleaning blade 4 | 1 | Single layered | 68 degrees | 30% | 89% |
| Ex. 5 | Cleaning blade 5 | 1 | Single layered | 68 degrees | 30% | 89% |
| Ex. 6 | Cleaning blade 6 | 1 | Single layered | 68 degrees | 30% | 89% |

TABLE 1-continued

| | Cleaning blade No. | Elastic member | | | | |
|---|---|---|---|---|---|---|
| | | No. | Structure | JIS-A hardness | Modulus of repulsion elasticity | Elastic power |
| Ex. 7 | Cleaning blade 7 | 1 | Single layered | 68 degrees | 30% | 89% |
| Ex. 8 | Cleaning blade 8 | 1 | Single layered | 68 degrees | 30% | 89% |
| Ex. 9 | Cleaning blade 9 | 1 | Single layered | 68 degrees | 30% | 89% |
| Ex. 10 | Cleaning blade 10 | 1 | Single layered | 68 degrees | 30% | 89% |
| Ex. 11 | Cleaning blade 11 | 1 | Single layered | 68 degrees | 30% | 89% |
| Ex. 12 | Cleaning blade 12 | 2 | Two-layered | 80 degrees + 75 degrees | 25% | 92% |
| Ex. 13 | Cleaning blade 13 | 2 | Two-layered | 80 degrees + 75 degrees | 25% | 92% |
| Comp. Ex. 1 | Cleaning blade 14 | 1 | Single layered | 68 degrees | 30% | 89% |
| Comp. Ex. 2 | Cleaning blade 15 | 1 | Single layered | 68 degrees | 30% | 89% |
| Comp. Ex. 3 | Cleaning blade 16 | 1 | Single layered | 68 degrees | 30% | 89% |
| Comp. Ex. 4 | Cleaning blade 17 | 1 | Single layered | 68 degrees | 30% | 89% |

TABLE 2

| | Ultraviolet-curable composition | | | | |
|---|---|---|---|---|---|
| | No. | Polymerizable monomer 1 | Polymerizable monomer 2 | Polymerization initiator | Solvent |
| Ex. 1 | 1 | Tricyclodecane dimethanol diacrylate | — | IRGACURE 184 | Cyclohexanone |
| Ex. 2 | 2 | Tricyclodecane dimethanol diacrylate | — | IRGACURE 184 | Cyclohexanone |
| Ex. 3 | 3 | Tricyclodecane dimethanol diacrylate | — | IRGACURE 184 | Cyclohexanone |
| Ex. 4 | 4 | Tricyclodecane dimethanol diacrylate | — | IRGACURE 184 | Cyclohexanone |
| Ex. 5 | 5 | (Meth)acrylate compound 1 having adamantane structure | — | IRGACURE 184 | Cyclohexanone |
| Ex. 6 | 6 | (Meth)acrylate compound 2 having adamantane structure | — | IRGACURE 184 | Cyclohexanone |
| Ex. 7 | 7 | (Meth)acrylate compound 3 having adamantane structure | — | IRGACURE 184 | Cyclohexanone |
| Ex. 8 | 8 | Tricyclodecane dimethanol diacrylate | Pentaerythritol triacrylate | IRGACURE 184 | Cyclohexanone |
| Ex. 9 | 9 | (Meth)acrylate compound 2 having adamantane structure | Pentaerythritol triacrylate | IRGACURE 184 | Cyclohexanone |
| Ex. 10 | 10 | Pentaerythritol triacrylate | — | IRGACURE 184 | Cyclohexanone |
| Ex. 11 | 11 | Dipentaerythritol hexaacrylate | — | IRGACURE 184 | Cyclohexanone |
| Ex. 12 | 1 | Tricyclodecane dimethanol diacrylate | — | IRGACURE 184 | Cyclohexanone |
| Ex. 13 | 5 | (Meth)acrylate compound 1 having adamantane structure | — | IRGACURE 184 | Cyclohexanone |
| Comp. Ex. 1 | | | Absent | | |
| Comp. Ex. 2 | 10 | Pentaerythritol triacrylate | — | IRGACURE 184 | Cyclohexanone |
| Comp. Ex. 3 | 11 | Dipentaerythritol hexaacrylate | — | IRGACURE 184 | Cyclohexanone |
| Comp. Ex. 4 | 4 | Tricyclodecane dimethanol diacrylate | — | IRGACURE 184 | Cyclohexanone |

TABLE 3

| | Cleaning performance | Amount of riding up [μm] | Amount of wear [μm] | Martens hardness of surface of reformed layer [N/mm$^2$] | Distance L [μm] | H/L [N/mm$^2$ · 1/μm] |
|---|---|---|---|---|---|---|
| Ex. 1 | A | 0 | 4 | 5.08 | 123.90 | 0.041 |
| Ex. 2 | A | 0 | 2 | 10.96 | 81.19 | 0.135 |

TABLE 3-continued

| | Cleaning performance | Amount of riding up [μm] | Amount of wear [μm] | Martens hardness of surface of reformed layer [N/mm$^2$] | Distance L [μm] | H/L [N/mm$^2$ · 1/μm] |
|---|---|---|---|---|---|---|
| Ex. 3 | A | 0 | 5 | 1.63 | 135.83 | 0.012 |
| Ex. 4 | A | 0 | 2 | 14.55 | 80.83 | 0.180 |
| Ex. 5 | A | 0 | 8 | 6.34 | 94.63 | 0.067 |
| Ex. 6 | A | 0 | 3 | 5.54 | 106.54 | 0.052 |
| Ex. 7 | A | 0 | 3 | 4.49 | 93.54 | 0.048 |
| Ex. 8 | A | 0 | 4 | 8.29 | 101.10 | 0.082 |
| Ex. 9 | A | 0 | 4 | 3.70 | 102.78 | 0.036 |
| Ex. 10 | A | 0 | 3 | 2.81 | 104.07 | 0.027 |
| Ex. 11 | A | 0 | 5 | 9.00 | 104.65 | 0.086 |
| Ex. 12 | A | 0 | 4 | 8.72 | 86.34 | 0.101 |
| Ex. 13 | A | 0 | 4 | 6.86 | 72.21 | 0.095 |
| Comp. Ex. 1 | B | 10 | Unmeasurable | 0.84 | Unmeasurable | Unmeasurable |
| Comp. Ex. 2 | B | 4 | Unmeasurable | 3.11 | 388.75 | 0.008 |
| Comp. Ex. 3 | B | 6 | Unmeasurable | 2.67 | 534.00 | 0.005 |
| Comp. Ex. 4 | B | 2 | Unmeasurable | 18.35 | 72.82 | 0.252 |

From the results of Table 3, it was revealed that the cleaning blades of Examples 1 to 13 could suppress the abutment part of the elastic member thereof from riding up, had little wear over the abutment part of the elastic member during use, and could maintain favorable cleaning performance for a long term, by the abutment part of the elastic member of the cleaning blades having a reformed layer, by the surface of the reformed layer having a Martens hardness of from 1.5 N/mm$^2$ to 15 N/mm$^2$, and by a relationship H/L being from 0.010 (N/mm$^2$·1/μM) to 0.2 (N/mm$^2$·1/μm), where the relationship was based on a Martens hardness H in a region inward from the abutment part thicknesswise and a distance L from the surface of the reformed layer.

Aspects of the present invention are as follows, for example.

<1> A cleaning blade, including:

an elastic member configured to abut on a surface of a cleaning target member and remove a residual material deposited on the surface of the cleaning target member, wherein the elastic member satisfies requirements a to c below, a. an abutment part of the elastic member that is to abut on the surface of the cleaning target member has a reformed layer, b. a Martens hardness at a surface of the reformed layer is from 1.5 N/mm$^2$ to 15 N/mm$^2$, and c. a relationship H/L between a maximum Martens hardness H among Martens hardnesses H in a region inward from the abutment part thicknesswise and a distance L from the surface of the reformed layer is from 0.010 (N/mm$^2$·1/m) to 0.2 (N/mm$^2$·1/μm), where the distance L represents a minimum distance among distances to the surface of the reformed layer, from positions at which a measured Martens hardness is equal to a Martens hardness of the elastic member, and a measured elastic power is equal to an elastic power of the elastic member.

<2> The cleaning blade according to <1>, wherein the reformed layer contains a cured product of an ultraviolet-curable composition containing a (meth)acrylate compound.

<3> The cleaning blade according to <2>, wherein the (meth)acrylate compound has an alicyclic structure having 6 or more carbon atoms in a molecule thereof.

<4> The cleaning blade according to <3>, wherein the (meth)acrylate compound having an alicyclic structure having 6 or more carbon atoms in a molecule thereof has 2 to 6 functional groups.

<5> The cleaning blade according to <3> or <4>, wherein the (meth)acrylate compound having an alicyclic structure having 6 or more carbon atoms in a molecule thereof has a molecular weight of 500 or less.

<6> The cleaning blade according to any one of <3> to <5>, wherein the (meth)acrylate compound having an alicyclic structure having 6 or more carbon atoms in a molecule thereof is at least one selected from the group consisting of a (meth)acrylate compound having a tricyclodecane structure, and a (meth)acrylate compound having an adamantane structure.

<7> The cleaning blade according to <6>, wherein the (meth)acrylate compound having a tricyclodecane structure is at least one selected from the group consisting of tricyclodecane dimethanol diacrylate, and tricyclodecane dimethanol dimethacrylate.

<8> The cleaning blade according to <6>, wherein the (meth)acrylate compound having an adamantane structure is at least one selected from the group consisting of 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

<9> The cleaning blade according to any one of <2> to <8>, wherein the ultraviolet-curable composition further contains a (meth)acrylate compound having a pentaerythritol tri(meth)acrylate structure having 3 to 6 functional groups.

<10> The cleaning blade according to any one of <1> to <9>, wherein the elastic member is a layered product obtained by integrally molding two or more kinds of rubbers having different JIS-A hardnesses.

<11> An image forming apparatus, including:

an image bearing member;

a charging unit configured to electrically charge a surface of the image bearing member;

an exposing unit configured to expose the electrically charged image bearing member to light and form an electrostatic latent image thereon;

a developing unit configured to develop the electrostatic latent image with a toner and form a visible image;

a transfer unit configured to transfer the visible image onto a recording medium;

a fixing unit configured to fix a transferred image transferred onto the recording medium thereon; and a cleaning unit configured to remove a toner remaining on the image bearing member, wherein the cleaning unit is the cleaning blade according to any one of <1> to <10>.

<12> A process cartridge, including at least:

an image bearing member; and a cleaning unit configured to remove a toner remaining on the image bearing member, wherein the cleaning unit is the cleaning blade according to any one of <1> to <10>.

This application claims priority to Japanese application No. 2013-236706, filed on Nov. 15, 2013 and incorporated herein by reference.

What is claimed is:

1. A cleaning blade, comprising:

an elastic member, and a support member attached to an upper portion of the elastic member, wherein the elastic member is configured to abut on a surface of a cleaning target member at a bottom portion of the elastic member and remove a residual material deposited on the surface of the cleaning target member, and the elastic member satisfies requirements (a), (b) and (c) below, (a) an abutment part of the elastic member is disposed at a bottom portion of the elastic member and includes a reformed layer formed in the abutment part by reforming treatment to the abutment part, (b) a Martens hardness at a surface of the reformed layer is from 3.0 $N/mm^2$ to 15 $N/mm^2$, and (c) a ratio H/L indicating a distribution of hardness in the reformed layer of the abutment part of the elastic member is from 0.03 ($N/mm^2 \cdot 1/\mu m$) to 0.2 ($N/mm^2 \cdot 1/\mu m$), where H represents a maximum Martens hardness among Martens hardnesses measured at a plurality of positions in a region inward from the abutment part thicknesswise and where L represents a distance in a thickness direction from the surface of the reformed layer.

2. The cleaning blade according to claim 1, wherein the reformed layer of the cleaning blade comprises a cured product of an ultraviolet-curable composition that comprises a (meth)acrylate compound.

3. The cleaning blade according to claim 2, wherein the (meth)acrylate compound has an alicyclic structure having 6 or more carbon atoms in a molecule thereof.

4. The cleaning blade according to claim 3, wherein the (meth)acrylate compound having an alicyclic structure having 6 or more carbon atoms in a molecule thereof has 2 to 6 functional groups.

5. The cleaning blade according to claim 3, wherein the (meth)acrylate compound having an alicyclic structure having 6 or more carbon atoms in a molecule thereof has a molecular weight of 500 or less.

6. The cleaning blade according to claim 3, wherein the (meth)acrylate compound having an alicyclic structure having 6 or more carbon atoms in a molecule thereof is at least one selected from the group consisting of a (meth)acrylate compound having a tricyclodecane structure, and a (meth)acrylate compound having an adamantane structure.

7. The cleaning blade according to claim 6, wherein the (meth)acrylate compound having a tricyclodecane structure is at least one selected from the group consisting of tricyclodecane dimethanol diacrylate, and tricyclodecane dimethanol dimethacrylate.

8. The cleaning blade according to claim 6, wherein the (meth)acrylate compound having an adamantane structure is at least one selected from the group consisting of 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

9. The cleaning blade according to claim 2, wherein the ultraviolet-curable composition further comprises a (meth)acrylate compound having a pentaerythritol tri(meth)acrylate structure having 3 to 6 functional groups.

10. The cleaning blade according to claim 1, wherein the elastic member is a layered product obtained by integrally molding two or more kinds of rubbers having different JIS-A hardnesses.

11. An image forming apparatus, comprising:

an image bearing member;

a charging unit configured to electrically charge a surface of the image bearing member;

an exposing unit configured to expose the electrically charged image bearing member to light and form an electrostatic latent image thereon;

a developing unit configured to develop the electrostatic latent image with a toner and form a visible image;

a transfer unit configured to transfer the visible image onto a recording medium;

a fixing unit configured to fix a transferred image transferred onto the recording medium thereon; and a cleaning unit configured to remove a toner remaining on the image bearing member, wherein the cleaning unit comprises an elastic member and a support member attached to an upper portion of the elastic member, and wherein the elastic member is configured to abut on a surface of a cleaning target member at a bottom portion of the elastic member and remove a residual material deposited on the surface of the cleaning target member, and the elastic member satisfies requirements (a), (b) and (c) below, (a) an abutment part of the elastic member is disposed at a bottom portion of the elastic member and includes a reformed layer formed in the abutment part by reforming treatment to the abutment part, (b) a Martens hardness at a surface of the reformed layer is from 3.0 $N/mm^2$ to 15 $N/mm^2$, and (c) a ratio H/L indicating a distribution of hardness in the reformed layer of the abutment part of the elastic member is from 0.03 ($N/mm^2 \cdot 1/\mu m$) to 0.2 ($N/mm^2 \cdot 1/\mu m$), where H represents a maximum Martens hardness among Martens hardnesses measured at a plurality of positions in a region inward from the abutment part thicknesswise and where L represents a distance in a thickness direction from the surface of the reformed layer.

12. A process cartridge, comprising:

an image bearing member; and a cleaning unit configured to remove a toner remaining on the image bearing member, wherein the cleaning unit comprises an elastic member and a support member attached to an upper portion of the elastic member, and wherein the elastic member is configured to abut on a surface of a cleaning target member at a bottom portion of the elastic member and remove a residual material deposited on the surface of the cleaning target member, and the elastic member satisfies requirements (a), (b) and (c) below, (a) an abutment part of the elastic member is disposed at a bottom portion of the elastic member and includes a reformed layer formed in the abutment part by reforming treatment to the abutment part, (b) a Martens hardness at a surface of the reformed layer is from 3.0 $N/mm^2$ to 15 $N/mm^2$, and (c) a ratio H/L indicating a distribution of hardness in the reformed layer of the abutment part of the elastic member is from 0.03 ($N/mm^2 \cdot 1/\mu m$) to 0.2 ($N/mm^2 \cdot 1/\mu m$), where H represents a maximum Martens hardness among Martens hardnesses measured at a plurality of positions in a region inward from the abutment part thicknesswise and where L represents a distance in a thickness direction from the surface of the reformed layer.

* * * * *